US009609918B2

(12) United States Patent
Beers

(10) Patent No.: US 9,609,918 B2
(45) Date of Patent: Apr. 4, 2017

(54) ARTICLE WITH CLOSED INSTEP PORTION HAVING VARIABLE VOLUME

(71) Applicant: Nike, Inc., Beaverton, OR (US)

(72) Inventor: Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 249 days.

(21) Appl. No.: 13/939,208

(22) Filed: Jul. 11, 2013

(65) Prior Publication Data

US 2015/0013184 A1 Jan. 15, 2015

(51) Int. Cl.

| | |
|---|---|
| ***A43C 11/00*** | (2006.01) |
| ***A43B 1/00*** | (2006.01) |
| ***A43B 3/00*** | (2006.01) |
| ***A43B 11/00*** | (2006.01) |
| ***A43B 23/02*** | (2006.01) |
| ***A43C 11/16*** | (2006.01) |

(52) U.S. Cl.

CPC ..... *A43C 11/004* (2013.01); *A43B 1/0018* (2013.01); *A43B 3/0005* (2013.01); *A43B 11/00* (2013.01); *A43B 23/027* (2013.01); *A43C 11/165* (2013.01)

(58) Field of Classification Search

CPC ... A43C 11/165; A43C 11/008; A43C 11/004; A43C 11/00; A43C 1/00; A43B 3/26; A43B 3/14; A43B 11/00; A43B 23/027; A43B 3/0005; A43B 1/0018

USPC ..... 36/83, 50.1, 119.1, 97, 118.1, 50.5; 24/68 SK

See application file for complete search history.

(56) References Cited

U.S. PATENT DOCUMENTS

| | | | | |
|---|---|---|---|---|
| 4,000,566 | A | 1/1977 | Famolare, Jr. | |
| 4,270,285 | A | 6/1981 | Antonious | |
| 4,408,403 | A | 10/1983 | Martin | |
| 4,654,985 | A | 4/1987 | Chalmers | |
| 4,811,503 | A * | 3/1989 | Iwama | A43B 5/0449 36/118.1 |
| 4,969,278 | A | 11/1990 | Ottieri | |
| 4,972,610 | A | 11/1990 | Tong | |
| 5,117,567 | A * | 6/1992 | Berger | A43B 1/0072 36/50.1 |
| 5,205,055 | A * | 4/1993 | Harrell | A43B 5/1633 36/50.1 |
| 5,325,613 | A | 7/1994 | Sussmann | |
| 5,337,493 | A | 8/1994 | Hill | |

(Continued)

FOREIGN PATENT DOCUMENTS

| | | | |
|---|---|---|---|
| GB | 2 256 574 | A | 12/1992 |
| WO | 93/25107 | A1 | 12/1993 |

(Continued)

OTHER PUBLICATIONS

International Search Report and Written Opinion mailed Nov. 7, 2014 in PCT/US2014/044480.

(Continued)

*Primary Examiner* — Anna Kinsaul
*Assistant Examiner* — Jillian K Pierorazio
(74) *Attorney, Agent, or Firm* — Banner & Witcoff, Ltd.

(57) ABSTRACT

An article of footwear includes an intermediate covering portion with an adjustable volume. The intermediate covering portion is closed around the instep of the foot. The article also includes a tensioning system that can be used to change the volume of the intermediate covering portion.

22 Claims, 20 Drawing Sheets

(56) References Cited

U.S. PATENT DOCUMENTS 5,425,185 A * 6/1995 Gansler ..... A43C 11/165 36/50.1
5,463,822 A * 11/1995 Miller ..... A43C 11/00 36/50.1
5,570,522 A 11/1996 Olson et al.
5,791,068 A 8/1998 Bernier et al.
5,839,210 A 11/1998 Bernier et al.
5,934,599 A 8/1999 Hammerslag
6,032,387 A * 3/2000 Johnson ..... 36/50.1
6,088,936 A * 7/2000 Bahl ..... A43B 7/20 36/50.1
6,378,230 B1 4/2002 Rotem et al.
6,416,074 B1 * 7/2002 Maravetz ..... A43B 5/0401 280/613
6,427,361 B1 8/2002 Chou
6,467,194 B1 * 10/2002 Johnson ..... A43C 1/06 36/118.1
6,691,433 B2 2/2004 Liu
7,065,906 B2 6/2006 Jones et al.
7,096,559 B2 8/2006 Johnson
7,134,224 B2 11/2006 Elkington et al.
7,281,341 B2 10/2007 Reagan et al.
7,370,440 B1 * 5/2008 Cole, III ..... A43B 5/003 36/50.1
7,392,990 B2 * 7/2008 Bussiere ..... A43B 5/1666 280/11.12
7,721,468 B1 * 5/2010 Johnson ..... A43C 1/06 36/118.1
7,752,774 B2 * 7/2010 Ussher ..... A43B 3/0005 36/100
8,061,061 B1 * 11/2011 Rivas ..... A43B 3/001 24/68 SK
8,146,273 B2 4/2012 Sokolowski
8,387,282 B2 3/2013 Baker et al.
8,468,657 B2 6/2013 Soderberg et al.
8,844,167 B2 9/2014 Greene
9,248,040 B2 * 2/2016 Soderberg ..... A61F 5/028
D751,281 S 3/2016 Nickel et al.
9,375,052 B2 6/2016 Krueger
2003/0204938 A1 * 11/2003 Hammerslag ..... A43B 5/16 24/68 SK
2004/0103560 A1 * 6/2004 Hollars ..... A43B 5/00 36/50.1
2004/0181972 A1 9/2004 Csorba
2005/0076536 A1 * 4/2005 Hatfield ..... A43B 3/0057 36/3 B
2005/0160627 A1 * 7/2005 Dalgaard ..... A43B 5/0401 36/50.5
2005/0198866 A1 * 9/2005 Wiper ..... A43B 5/14 36/50.1
2005/0198867 A1 * 9/2005 Labbe ..... A43B 11/00 36/50.1
2006/0021204 A1 * 2/2006 Young ..... A43C 7/00 24/712.4
2006/0162190 A1 * 7/2006 Nishiwaki ..... A43B 5/10 36/97
2006/0191164 A1 * 8/2006 Dinndorf ..... A43B 3/0031 36/50.1
2007/0033836 A1 2/2007 Rasmussen
2007/0039209 A1 2/2007 White et al.
2007/0186447 A1 8/2007 Ramos
2007/0209234 A1 9/2007 Chou
2007/0240334 A1 10/2007 Johnson
2008/0066345 A1 * 3/2008 Hammerslag et al. ..... 36/50.1
2008/0086911 A1 * 4/2008 Labbe ..... A43B 11/00 36/50.1
2008/0216351 A1 9/2008 Carroll et al.
2009/0000153 A1 1/2009 Grimmeisen
2010/0139057 A1 6/2010 Soderberg et al.
2010/0251564 A1 * 10/2010 Meschter ..... A43B 23/0225 36/28
2010/0319216 A1 * 12/2010 Grenzke ..... A43C 1/00 36/54
2011/0258876 A1 10/2011 Baker et al.
2012/0005923 A1 1/2012 Beers et al.
2012/0117821 A1 5/2012 Adams et al.
2012/0240428 A1 * 9/2012 Knoll ..... A43B 5/0427 36/50.1
2014/0070042 A1 3/2014 Beers et al.

FOREIGN PATENT DOCUMENTS

WO 2006/074067 A1 7/2006
WO 2009/071652 A1 6/2009

OTHER PUBLICATIONS

International Search Report and Written Opinion mailed Jul. 31, 2015 in PCT/US2015/029401.
Office Action dated Sep. 5, 2016 in Chinese Patent Application No. 201480031216.2.
International Preliminary Report on Patentability and Written Opinion of the International Searching Authority issued Jan. 21, 2016 in International Patent Application No. PCT/US2014/044480.

* cited by examiner

ARTICLE WITH CLOSED INSTEP PORTION HAVING VARIABLE VOLUME

BACKGROUND

The present embodiments relate generally to articles of footwear, and in particular to an article of footwear with a closed instep portion.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

SUMMARY

In one aspect, an article of footwear includes upper having a toe covering portion and an entry hole for receiving a foot, an intermediate covering portion disposed between the toe covering portion and the entry hole, where the intermediate covering portion is closed around the instep of the foot and wherein the volume of the intermediate covering portion is variable and at least one tensioning member extending through the intermediate covering portion. Increasing the tension of the tensioning member substantially decreases the volume of the intermediate covering portion.

In another aspect, an article of footwear includes an upper having a toe covering portion and an entry hole for receiving a foot, an intermediate covering portion disposed between the toe covering portion and the entry hole, where the intermediate covering portion is closed around the instep of the foot and wherein the volume of the intermediate covering portion is variable and at least one tensioning member extending through the intermediate covering portion. The volume of the intermediate covering portion can be changed by adjusting the tension of the at least one tensioning member and the tension of the tensioning member is controlled using a reel-based tensioning device.

In another aspect, an article of footwear includes an upper having a toe covering portion and an entry hole for receiving a foot, an intermediate covering portion disposed between the toe covering portion and the entry hole, where the intermediate covering portion is closed around the instep of the foot and wherein the volume of the intermediate covering portion is variable. The article further includes a tensioning device, a first tensioning member, a second tensioning member and a third tensioning member all extending between the tensioning device and the intermediate covering portion. The first tensioning member, the second tensioning member and the third tensioning member extend radially outward from an aperture on the article of footwear.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

FIGS. 1 through 4 illustrate schematic isometric views of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Figure 1:
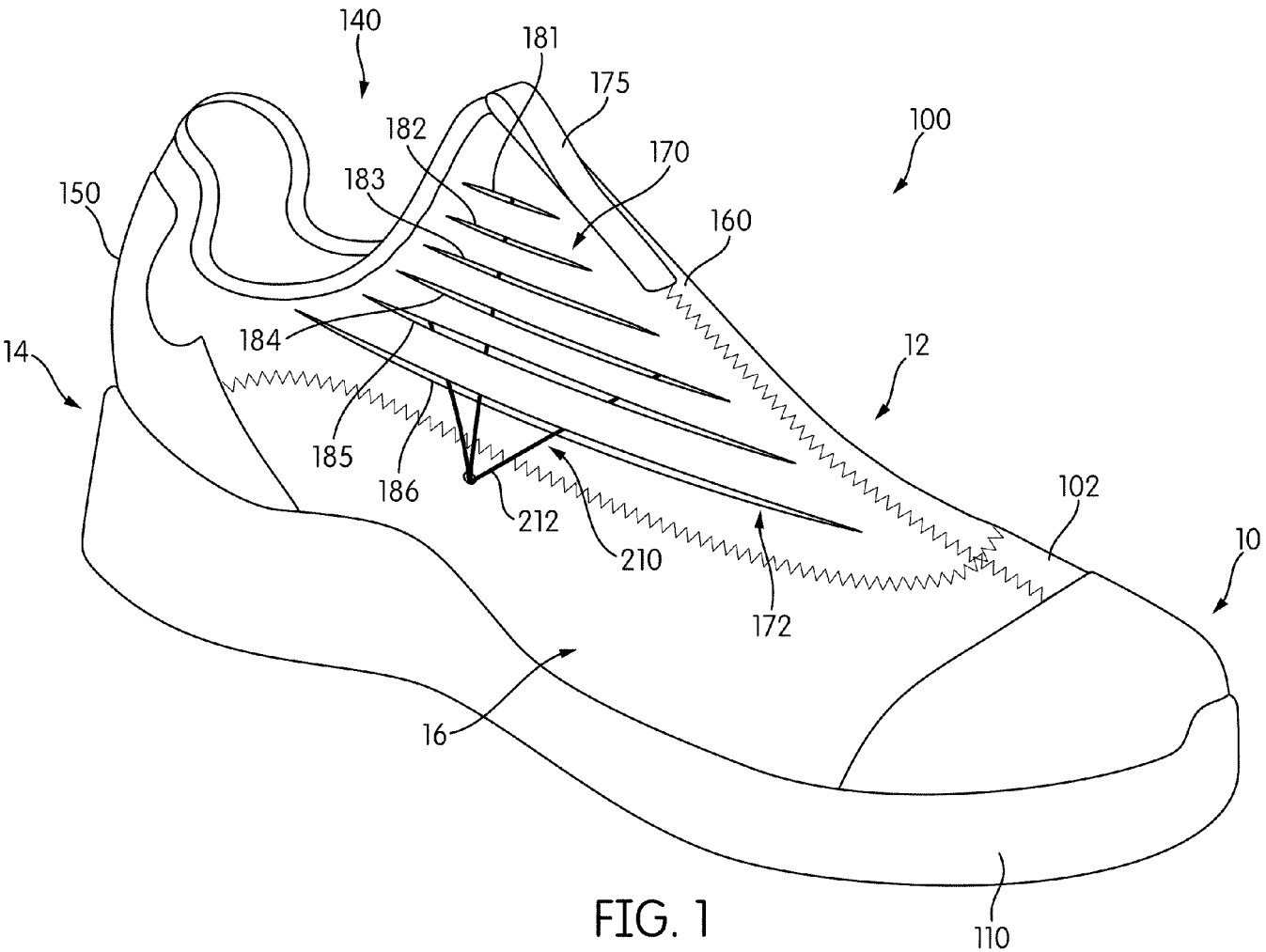
FIG. 1 is a lateral isometric view of an embodiment of an article of footwear.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing individual components of an article, such as an upper and/or a sole structure.

Referring to FIGS. 1 through 4, article 100 may include an upper 102 as well as a sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120 and outsole 122. As discussed in further detail below, some embodiments may include sole structures with internal cavities or recesses for receiving various components, for example a cavity for receiving an electronic device.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Figure 3:
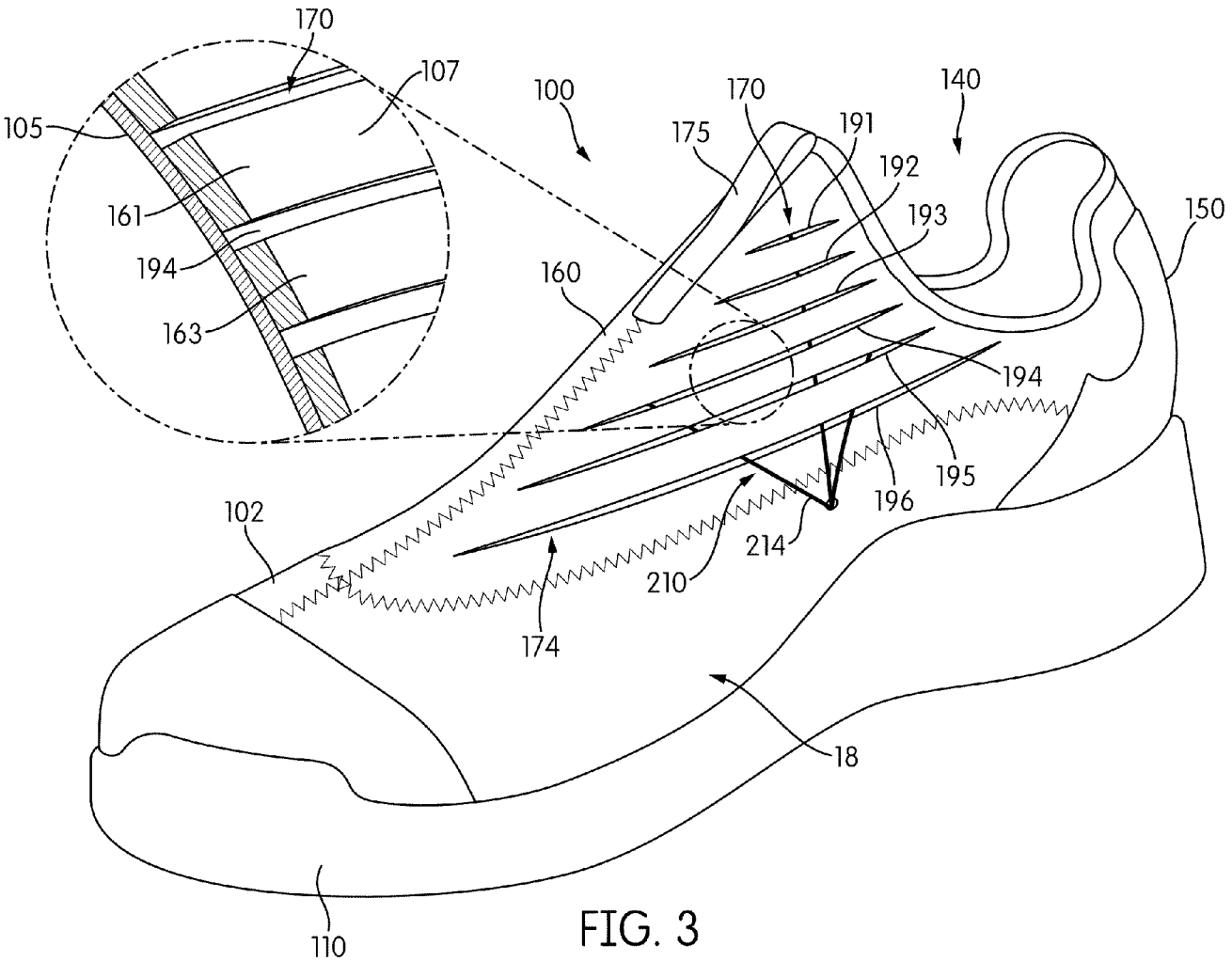
FIG. 3 is a medial isometric view of an embodiment of an article of footwear.

In different embodiments, the material construction of upper 102 could vary. In some embodiments, upper 102 may comprise a single base layer of material, such as, for example, a synthetic material layer. In other embodiments, however, upper 102 could comprise two or more material layers. As seen in FIG. 3, in some embodiments, upper 102 may be constructed with an inner layer 105 and an outer layer 107. In some cases, inner layer 105 could be substantially more elastic than outer layer 107. In other cases, however, inner layer 105 could be less elastic and/or have a similar elasticity to outer layer 107. In some embodiments, inner layer 105 could be a mesh layer, while outer layer 107 could be a foam layer. In some cases, the foam material of outer layer 107 may be less elastic than mesh material of inner layer 105.

In some embodiments, upper 102 includes opening 140 that provides entry for the foot into an interior cavity of upper 102. Opening 140 may be bounded from a rearward direction by heel portion 150 of upper 102. In some embodiments, upper 102 further includes an instep portion 160 that corresponds to the top of a foot.

In contrast to some other upper configurations, article 100 may generally be closed along the top of upper 102, including along instep portion 160. In other words, instep portion 160 may be configured as a closed portion. In particular, instep portion 160 may be closed around the instep of a foot, when a foot has been inserted into article 100.

For purposes of clarity, the term "intermediate covering portion" is used throughout this detailed description and in the claims to refer to a portion of an upper corresponding to an instep of the foot and surrounding parts of the foot. In some embodiments, the intermediate covering portion may include portions of the vamp, but not necessarily all of the vamp. Moreover, the intermediate covering portion described herein is most generally characterized as including the portions of the upper between a toe portion of the upper and an entry hole or opening of the upper.

Figure 5:
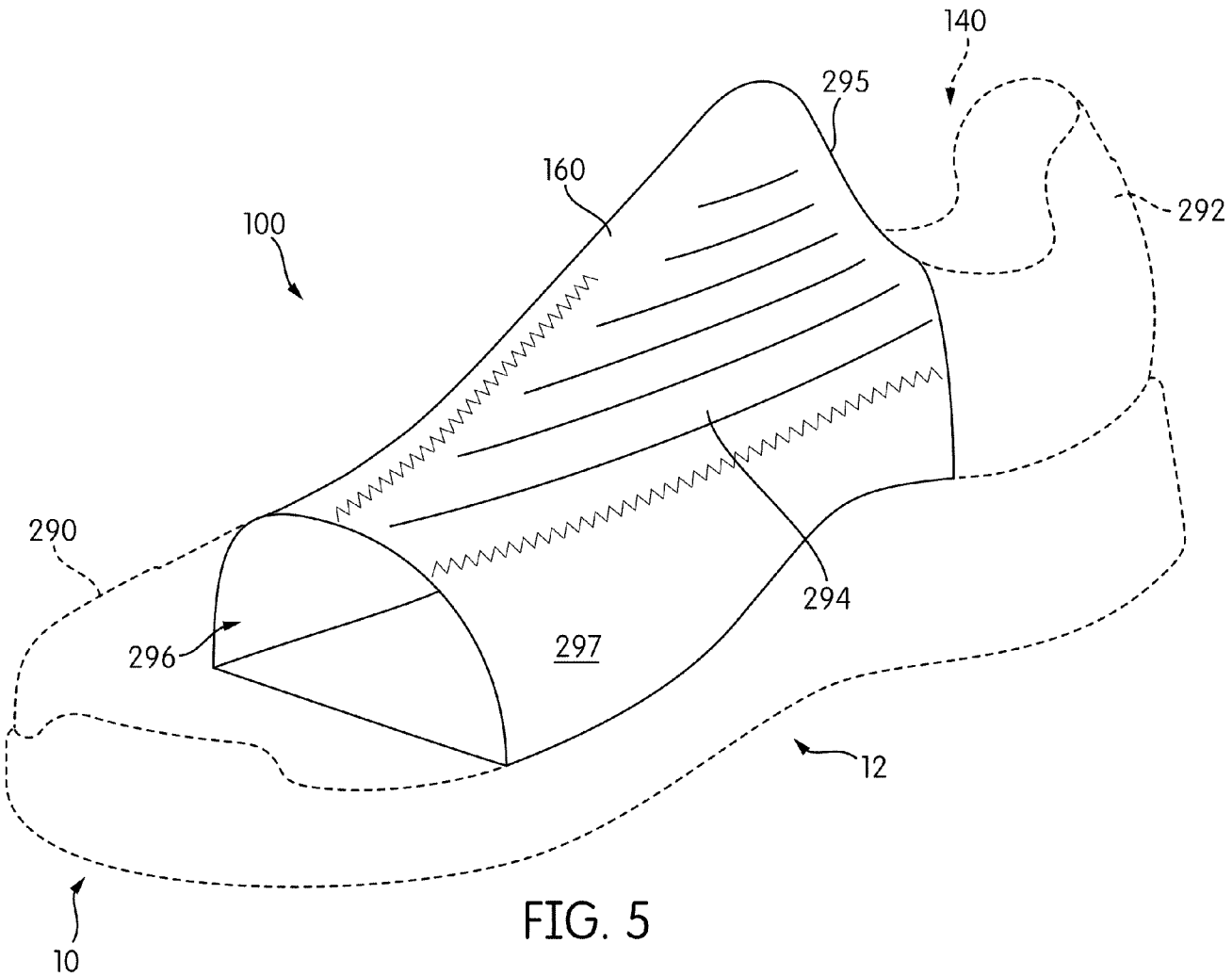
FIG. 5 is a schematic isometric view of an embodiment of an article of footwear, in which an intermediate covering portion is clearly depicted.

FIG. 5 illustrates a schematic view of an embodiment of article 100, in which an intermediate covering portion of article 100 has been highlighted. Referring to FIG. 5, article 100 may be characterized as having a toe covering portion 290, a rearward covering portion 292 and an intermediate covering portion 294 disposed between the toe covering portion 290 and the rearward covering portion 292. In FIG.

5, toe covering portion 290 and rearward covering portion 292 are indicated in phantom, while intermediate covering portion 294 is indicated with solid lines. In some embodiments, intermediate covering portion 294 may be bounded in a rearward direction by a forward edge 295 of opening 140. Moreover, intermediate covering portion 294 may include portions of forefoot portion 10 and/or midfoot portion 12. Further, intermediate covering portion 294 can include some or all of instep portion 160. Thus, in some embodiments, intermediate covering portion 294 generally covers the part of a foot forwards of the ankle and rearwards of the toes.

In some embodiments, intermediate covering portion 294 may generally define a volume 296, whose boundaries are associated with a surface 297 defined by intermediate covering portion 294. As portions of article 100 are expanded and contracted in response to changes in tension of various tensioning members, volume 296 may generally change accordingly. Thus, for example, as portions of article 100 contract with increased tension of tensioning system 200, volume 296 may decrease. Likewise, as portions of article 100 expand with decreased tension of tensioning system 200, volume 296 may increase.

In order to facilitate entry of a foot into upper 102, intermediate covering portion 294 may include provisions for expanding and contracting, especially at instep portion 160, which may be part of intermediate covering portion 294. In some embodiments, instep portion 160 may be configured with a plurality of channels 170 to facilitate expansion of instep portion 160, or more intermediate covering portion 294, as described in further detail below. In some embodiments, plurality of channels 170 further includes a first group of channels 172 and a second group of channels 174, associated with the lateral side 16 and medial side 18, respectively, of upper 102.

Referring to FIG. 1, in some embodiment, first group of channels 172 further comprises a first channel 181, a second channel 182, a third channel 183, a fourth channel 184, a fifth channel 185 and a sixth channel 186. Likewise, as seen in FIG. 3, second group of channels 174 further comprises a first channel 191, a second channel 192, a third channel 193, a fourth channel 194, a fifth channel 195 and a sixth channel 196. In some cases, the channels of first group of channels 172 and second group of channels 174 may be in one to one correspondence. For example, in some cases, first channel 181 of first group of channels 172 may correspond with first channel 191 of second group of channels 174. In particular, first channel 181 and first channel 191 may both have similar relative locations on lateral side 16 and medial side 18, respectively, of instep portion 160. Likewise, first channel 181 and first channel 191 could have substantially similar sizes and/or orientations on instep portion 160. In other embodiments, however, the channels of first group of channels 172 may not be in one to one correspondence with channels of second group of channels 174. For example, in other embodiments, instep portion 160 could include six channels on lateral side 16 and five channels on medial side 18.

In different embodiments, the depths of plurality of channels 170 relative to the material thickness of upper 102 can vary. In some embodiments, for example, plurality of channels 170 may be configured as channels extending through the entire thickness of upper 102. In other embodiments, however, plurality of channels 170 may not extend through the entire thickness of an upper material. In some embodiments, as seen in FIG. 3, plurality of channels 170 may extend through outer layer 107, but not through inner layer 105, of upper 102. Thus, plurality of channels 170 may generally separate adjacent segments of material in outer layer 107. For example, fourth channel 194 is seen to separate section 161 of outer layer 107 from section 163 of outer layer 107. With this arrangement, as upper 102 is stretched along instep portion 160, inner layer 105 may stretch accordingly, with adjacent sections of outer layer 107 further separating as plurality of channels 170 expand.

Figure 8:
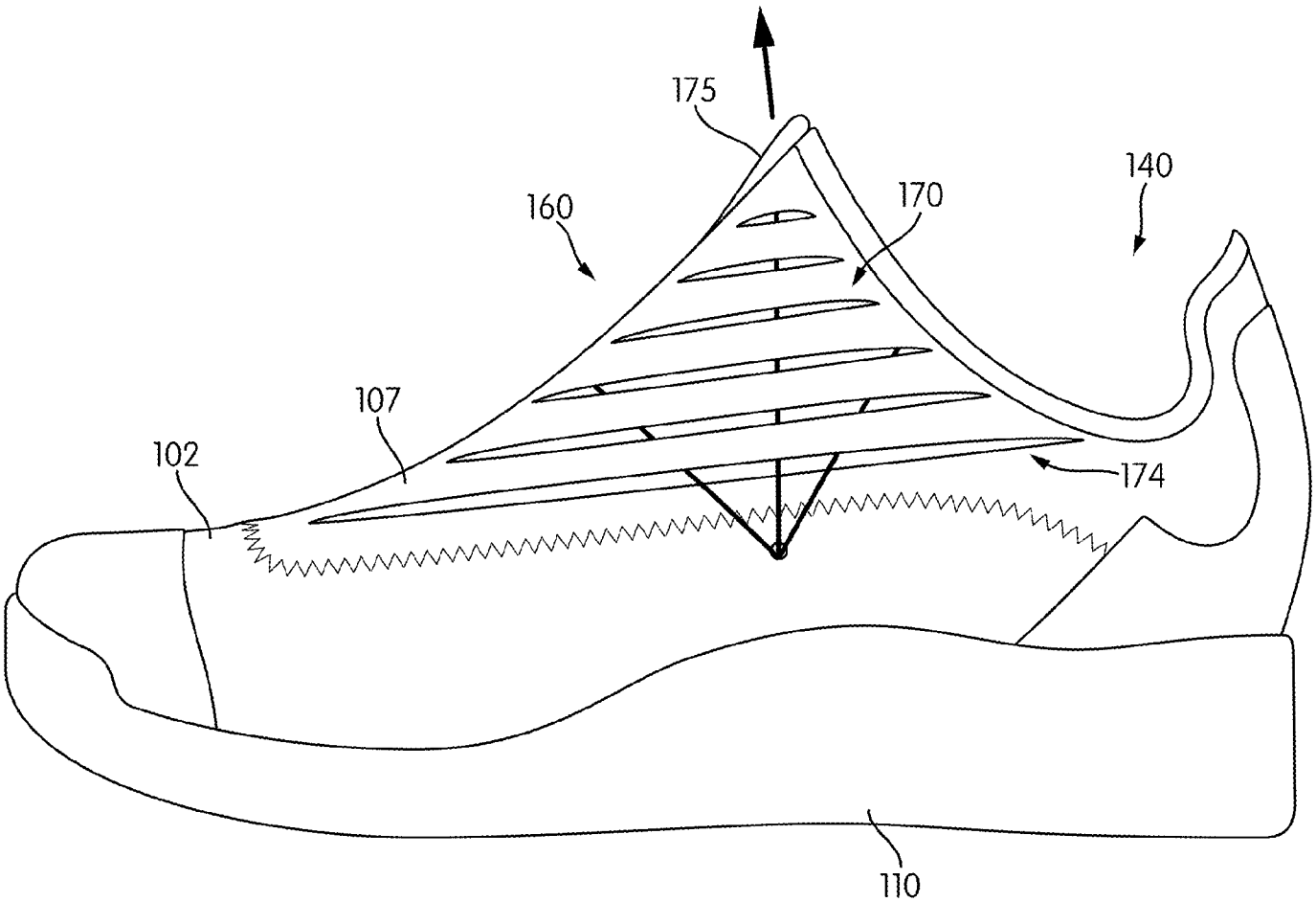
FIG. 8 is a side view of an embodiment of an article of footwear in which an instep portion undergoes expansion.

In different embodiments, the orientations of plurality of channels 170 could vary. In some embodiments, the channels comprising first group of channels 172 may be generally parallel to one another. In addition, in some cases, the channels comprising first group of channels 172 may be approximately oriented in the longitudinal direction. In a similar manner, in some embodiments, the channels comprising second group of channels 174 may be generally parallel and oriented approximately in the longitudinal direction. This general configuration for plurality of channels 170 on instep portion 160 may facilitate the expansion of instep portion 160, and of intermediate covering portion 294 more generally, in a direction that is generally perpendicular with the lengthwise orientations of plurality of channels 170. More specifically, as plurality of channels 170 expand along a widthwise direction of the channels that is generally perpendicular to the longitudinal direction of upper 102, instep portion 160 may expand in a direction approximately parallel to that widthwise direction. Such an expanded configuration is shown in FIG. 8 and described in further detail below. Moreover, as discussed further below, the expansion of plurality of channels 170 may result in a net increase in volume for portions of article 100, including for instance, an increase in the volume of instep portion 160 and of intermediate covering portion 294.

Some embodiments may include tab portion 175. In some embodiments, tab portion 175 is a tab-like portion disposed along the top of instep portion 160. In some embodiments, tab portion 175 has a looped geometry that can be easily grasped with a finger. In some cases, tab portion 175 may be disposed adjacent to opening 140. Tab portion 175 may be grasped and pulled by a user to expand instep portion 160. This allows opening 140 to increase in size temporarily, thereby permitting entry of a foot through opening 140. With tab portion 175 released, instep portion 160 may return to a pre-tensioned size and/or volume.

Embodiments can include provisions to facilitate contracting instep portion 160 (and thereby reducing its volume) once a foot has been inserted in order to tighten the fit of upper 102 to the foot. In some embodiments, article 100 may include tensioning system 200 (indicated in FIGS. 2 and 4) that may provide tension across instep portion 160. Tensioning system 200 may further comprise one or more tensioning members as well as a tensioning device. Examples of possible tensioning members that could be used include, but are not limited to: cables, wires, strings, laces, straps as well as any other kinds of tensioning members. Moreover, exemplary tensioning devices include, but are not limited to: winding devices (e.g., reels and spools), springs, as well as any other devices, systems or components that can be used to apply tension to any portion of a tensioning member.

In some embodiments, tensioning system 200 may include plurality of tensioning members 210. Plurality of tensioning members 210 may comprise cable-like or wire-like members. In particular, the tensioning members of the current embodiment may be characterized as being approximately one-dimensional. In other words, each tensioning member may generally have a length that is substantially greater than the width, thickness and/or diameter of the tensioning member. In other embodiments, however, one or more tensioning members could be approximately two-dimensional members (e.g., ribbons or straps).

Figure 2:
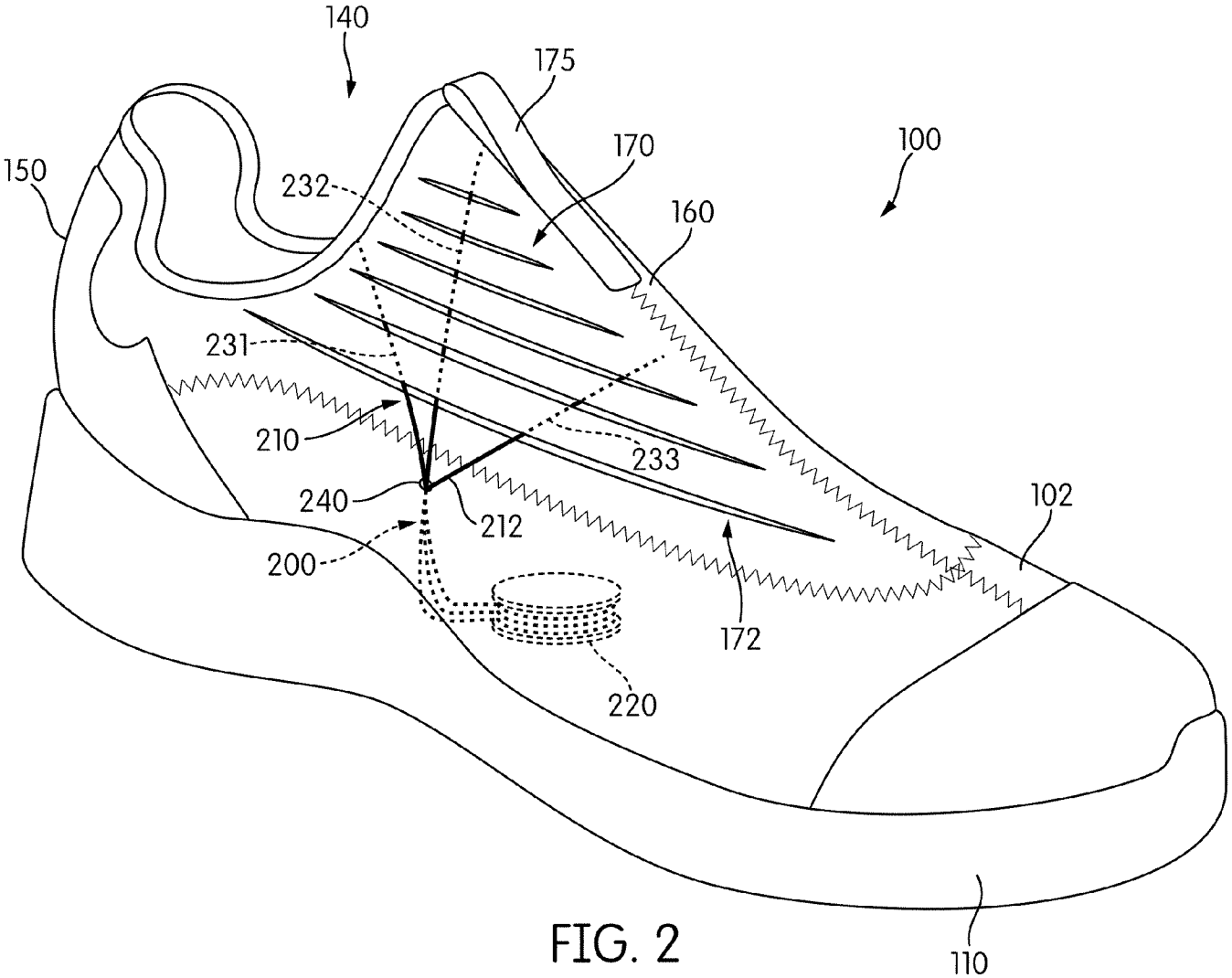
FIG. 2 is a lateral isometric view of an embodiment of an article of footwear including portions of a tensioning system shown in phantom.
Figure 4:
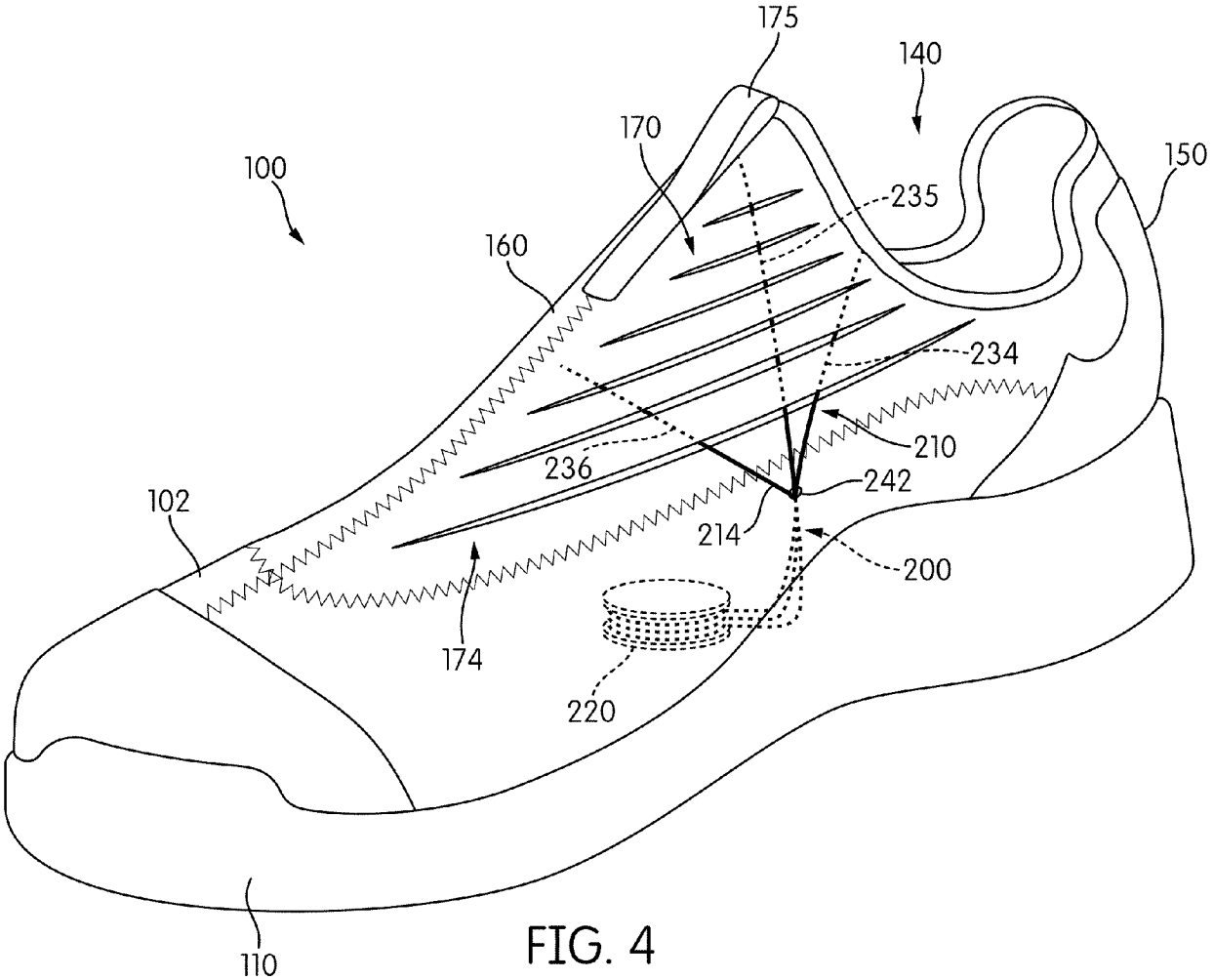
FIG. 4 is a medial isometric view of an embodiment of an article of footwear including portions of a tensioning system shown in phantom.

Plurality of tensioning members 210 may be further grouped into a first group of tensioning members 212 and a second group of tensioning members 214, which are associated with lateral side 16 and medial side 18, respectively, of upper 102. Generally, each group could have any number of tensioning members. In some embodiments, first group of tensioning members 212 and second group of tensioning members 214 may each comprise three distinct tensioning members. However, other embodiments could include any other number of tensioning members in each group of tensioning members, including one, two, three, four or more than four tensioning members. In particular, as seen in FIG. 2, first group of tensioning members 212 may include first tensioning member 231, second tensioning member 232 and third tensioning member 233. Likewise, as seen in FIG. 4, second group of tensioning members 214 may include fourth tensioning member 234, fifth tensioning member 235 and sixth tensioning member 236.

Tensioning system 200 further includes tensioning device 220 that may be used to adjust the tension in plurality of tensioning members 210. For purposes of clarity, tensioning device 220 is shown schematically in the current embodiments. However, tensioning device 220 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Pat. No. 8,468,657, issued on Jun. 25, 2013 and titled "Reel Based Lacing System", the entirety of which is hereby incorporated by reference. Examples of a motorized tensioning device that could be used with the current embodiments are disclosed in Beers, U.S. Patent Application Publication Number 2014/0070042, now U.S. patent application Ser. No. 14/014,555, filed Aug. 30, 2013, and titled "Motorized Tensioning System with Sensors", the entirety being incorporated by reference herein. In an exemplary embodiment, tensioning device 220 could be a reel-based tensioning device that winds the tensioning members onto a reel to increase the tension.

In different embodiments, the location of tensioning device 220 could vary. In some embodiments, tensioning device 220 could be disposed in a portion of upper 102. In some embodiments, as shown in FIGS. 2 and 4, tensioning device 220 could be disposed in a portion of sole structure 110. In particular, in some cases, tensioning device 220 could be embedded within an internal cavity of sole structure 110. For purposes of clarity, the location of tensioning device 220 is shown schematically in the figures, but it will be appreciated that any method known in the art for incorporating various rigid components and devices into a sole and/or upper can be used.

Referring now to FIG. 2, the tensioning members of tensioning system 200 may generally extend from tensioning device 220 in sole structure 110 to portions of upper 102. For example, first tensioning member 231, second tensioning member 232 and third tensioning member 233 may extend from tensioning device 220, travel through and exit sole structure 110 and enter upper 102. In some embodiments, portions of each tension member may travel internally to upper 102, either along an inner side surface of upper 102, or between adjacent layers of upper 102 (such as between outer layer 107 and inner layer 105). First tensioning member 231, second tensioning member 232 and third tensioning member 233 may generally exit upper 102 at aperture 240. From aperture 240, first tensioning member 231, second tensioning member 232 and third tensioning member 233 may travel through instep portion 160. As discussed in further detail below, in some embodiments, first tensioning member 231, second tensioning member 232 and third tensioning member 233 may extend generally adjacent to one another from tensioning device 220 to aperture 240, but may separate and extend in various different directions upon exiting aperture 240. This arrangement allows lateral side 16 of instep portion 160 to be contracted by applying tension to first group of tensioning members 212 using tensioning device 220.

Referring now to FIG. 4, in some embodiments, fourth tensioning member 234, fifth tensioning member 235 and sixth tensioning member 236 may be configured in a similar manner to first tensioning member 231, second tensioning member 232 and third tensioning member 233. That is, fourth tensioning member 234, fifth tensioning member 235 and sixth tensioning member 236 may extend from tensioning device 220, travel through and exit sole structure 110 and enter upper 102. Each tensioning member may extend through a portion of upper 102 and exit upper 102 at aperture 242 on medial side 18. From upper opening 242, fourth tensioning member 234, fifth tensioning member 235 and sixth tensioning member 236 may extend through instep portion 160. This arrangement allows medial side 18 of instep portion 160 to be contracted by applying tension to second group of tensioning members 214 using tensioning device 220.

Figure 6:
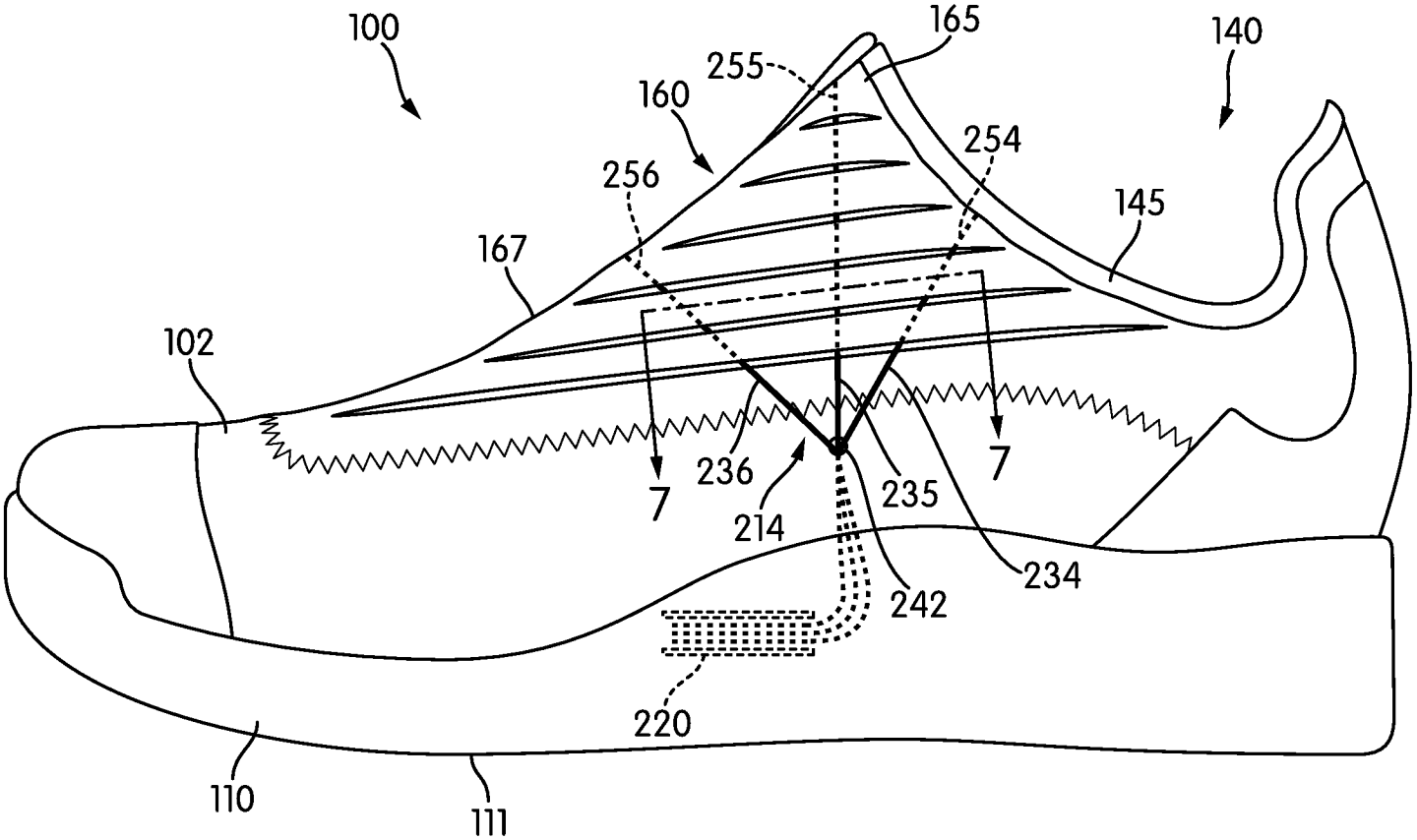
FIG. 6 is a side view of an embodiment of an article of footwear including a tensioning system for adjusting the volume of an instep portion.

FIG. 6 illustrates a medial side view of article 100. Referring to FIG. 6, the configuration of second group of tensioning members 214 along instep portion 160 can be clearly seen. In particular, after exiting upper opening 242, fourth tensioning member 234, fifth tensioning member 235 and sixth tensioning member 236 each extend towards the top of instep portion 160. Moreover, the tensioning members generally spread out in a radial direction from aperture 242. In some embodiments, fourth tensioning member 234 extends from aperture 242 to a periphery 145 of opening 140. Periphery 145 may be seen to bound instep portion 160 from the rearward direction. In some cases, an end portion 254 of fourth tensioning member 234 may be secured, or otherwise anchored, to a point along periphery 145. Likewise, fifth tensioning member 235 extends from aperture 242 to a top portion 165 of instep portion 160 that is generally vertically furthest from a lower surface 111 of sole structure 110. In some cases, an end portion 255 of fifth tensioning member 235 may be secured, or otherwise anchored, to top portion 165 of instep portion 160. In addition, sixth tensioning member 236 extends from aperture 242 to an upper forward portion 167 of instep portion 160. In some cases, an end portion 256 of sixth tensioning member may be secured, or otherwise anchored, to upper forward portion 167 of instep portion 160.

It will be understood that tensioning members of first group of tensioning members 212 may be configured in a similar manner on lateral side 16 of article 100. In particular, first tensioning member 231, second tensioning member 232 and third tensioning member 233 may extend outwardly from aperture 240 in a similar manner to fourth tensioning member 234, fifth tensioning member 235 and sixth tensioning member 236. In some embodiments, this arrangement may provide substantially symmetric tension along the lateral and medial sides of instep portion 160, thereby allowing tension to be applied in a generally symmetric manner. In other embodiments, however, first group of tensioning members 212 and second group of tensioning members 214 need not be arranged in a symmetric manner.

Figure 7:
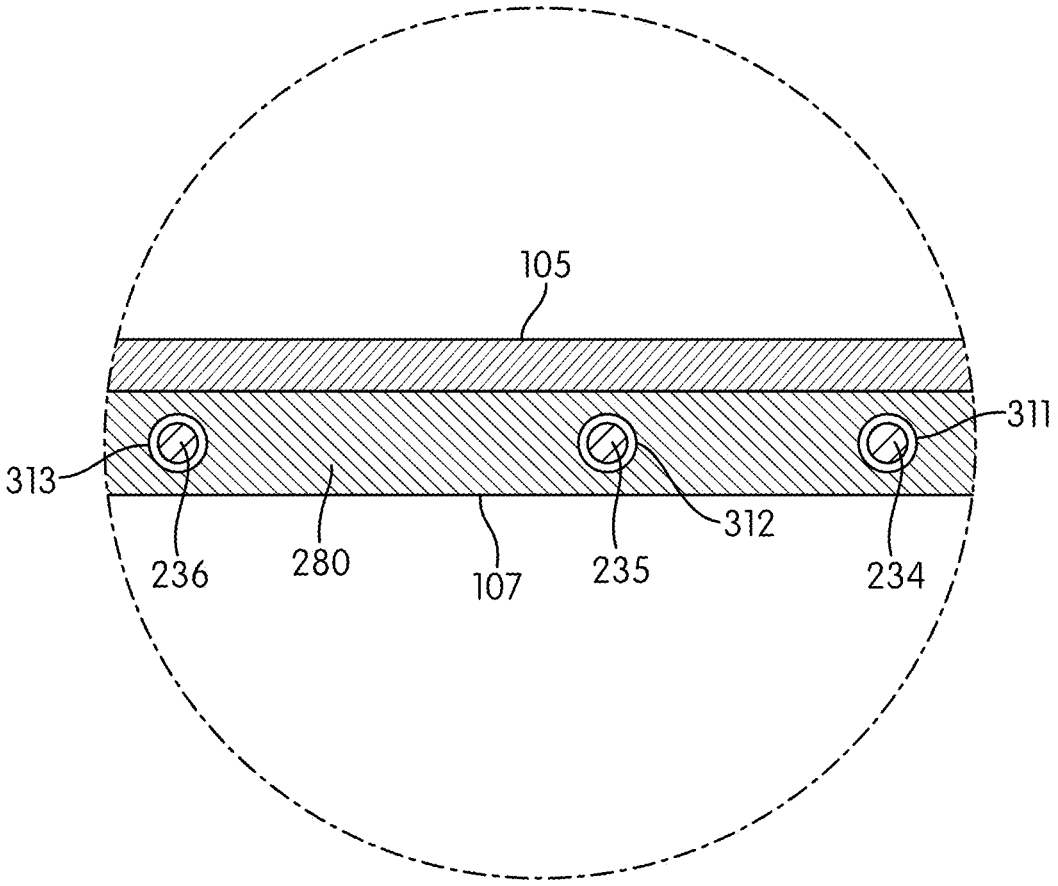
FIG. 7 is an enlarged cross-sectional view of an embodiment of an inner layer and an outer layer of an upper.

FIG. 7 is a cross-sectional view of a portion of upper 102, in which the layered structure of upper 102 is clearly seen. As seen in FIG. 7, in some embodiments one or more tensioning members may extend through cavities within outer layer 107. For example, in the current embodiment fourth tensioning member 234, fifth tensioning member 235 and sixth tensioning member 236 may extend through a first cavity 311, a second cavity 312 and third cavity 313, respectively. First cavity 311, second cavity 312 and third cavity 313 may be formed in a segment 280 of outer layer 107, which may be a segment disposed between adjacent channels of instep portion 160. In some embodiments, other portions of outer layer 107 may also include cavities to receive portions of each tensioning member. Using this arrangement, each tensioning member of second group of tensioning members 214 may be guided through instep portion 160 in a desired configuration.

With respect to tensioning members and the layers of upper 102, it will be understood that other arrangements are possible. In some other embodiments, one or more tensioning members could extend between outer layer 107 and inner layer 105. In still other embodiments, one or more tensioning members could extend externally to outer layer 107. In still other embodiments, one or more tensioning members could extend along an inner side of inner layer 105 (i.e., directly adjacent to a foot). In such an embodiment, tubes or other guides may be used to facilitate cushioning between the tensioning members and the foot.

Some embodiments could incorporate one or more internal and/or external guides that facilitate the alignment and travel of tensioning members. In some embodiments, one or more guides could be disposed within cavities of outer layer 107. In other embodiments, guides could be used to house portions of tensioning members that extend between cavities in adjacent sections of material. The use of guides, such as tubes, may further facilitate alignment of tensioning members and allow for smoother travel of the tensioning members. Such provisions, as well as the presence of inner layer 105, could also reduce the tendency of the tensioning members to apply unwanted pressures directly to the foot.

FIG. 8 illustrates a side view of article 100, in which instep portion 160 is undergoing expansion. As seen in FIG. 8, tension may be applied to tab portion 175 to expand instep portion 160. In particular, as tension is applied to instep portion 160, plurality of channels 170 (including second group of channels 174) expand as adjacent segments of outer layer 107 are separated from one another. As previously discussed, plurality of channels 170 may generally expand in along their width, which is generally perpendicular to the longitudinal direction of article 100. This expansion in the volume of instep portion 160 may increase the size of opening 140. This temporary increase in the size of opening 140 allows a user to easily insert their foot into upper 102.

Figure 9:
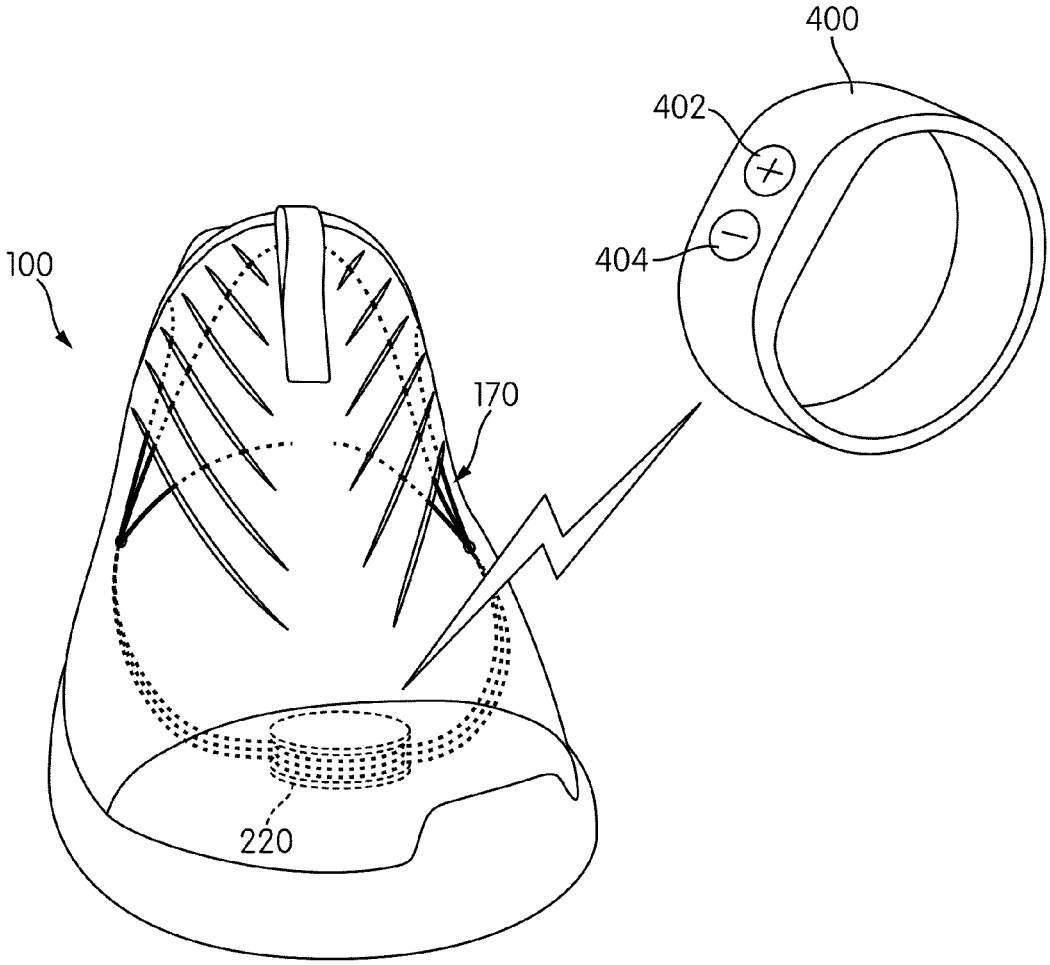
FIG. 9 is a schematic view of an embodiment of an article including a tensioning system and a remote device configured to operate the tensioning system.

FIG. 9 illustrates a schematic view of article 100 and a remote device 400. Remote device 400 may be in communication with tensioning device 220. In some embodiments, remote device 400 can include provisions that allow a user to remotely adjust the tension applied by tensioning device 220. In one embodiment, remote device 400 may include a tightening button 402 (indicated in FIG. 9 as a "plus" symbol) and a loosening button 404 (indicated in FIG. 9 as a "minus" symbol). This allows a user to adjust the tension by pressing tightening button 402 and/or loosening button 404. It will be understood that the tension could be adjusted in discrete steps (i.e., an incremental adjustment in tension each time a button is pressed) or could occur continuously (i.e., the tension is continuously adjusted as long as a button remains depressed).

In the current embodiment, remote device 400 is shown as a bracelet that may be worn by a user. In other embodiments, however, remote device 400 could be any other kind of device. Examples of other remote devices that could be used to communicate with tensioning device 220 include, but are not limited to: cell phones, smart phones, tablets, various kinds of remote control devices as well as any other kinds of remote devices. Moreover, a remote device can communicate with tensioning device 220 using any communication method including, but not limited to: radio signals, infra-red signals, as well as any other kinds of communication signals known in the art.

It will be understood that while the embodiments of the figures illustrate a tensioning system that uses a single tensioning device, other embodiments could incorporate two or more tensioning devices. In still another embodiment, for example, an article could include a separate tensioning device on each of the lateral and medial sides of the article. This alternative configuration could facilitate independent tensioning of tensioning members associated with the lateral and medial sides.

Figure 10:
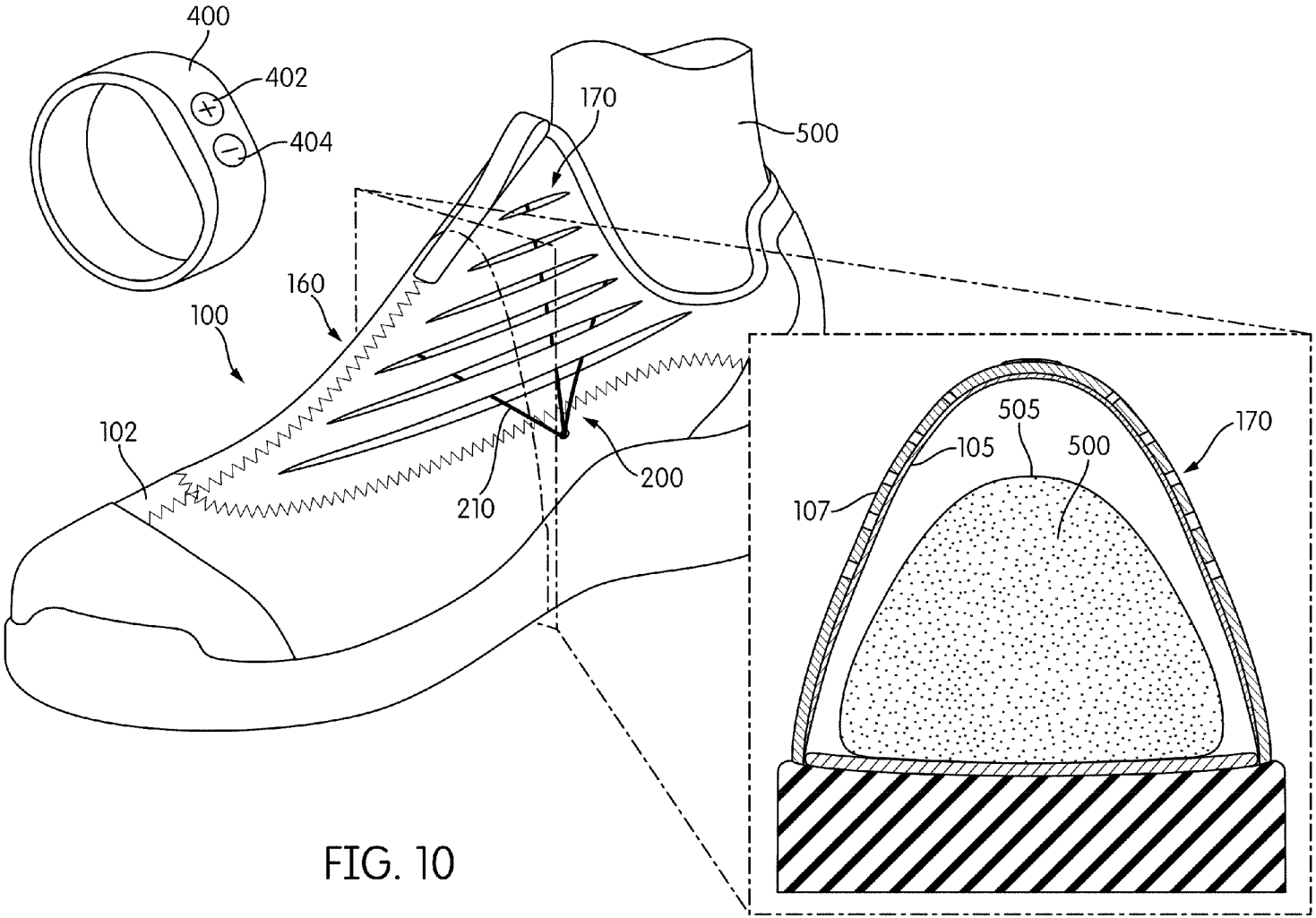
FIG. 10 is a schematic view of an embodiment of an article of footwear with a foot inserted into an upper.
Figure 11:
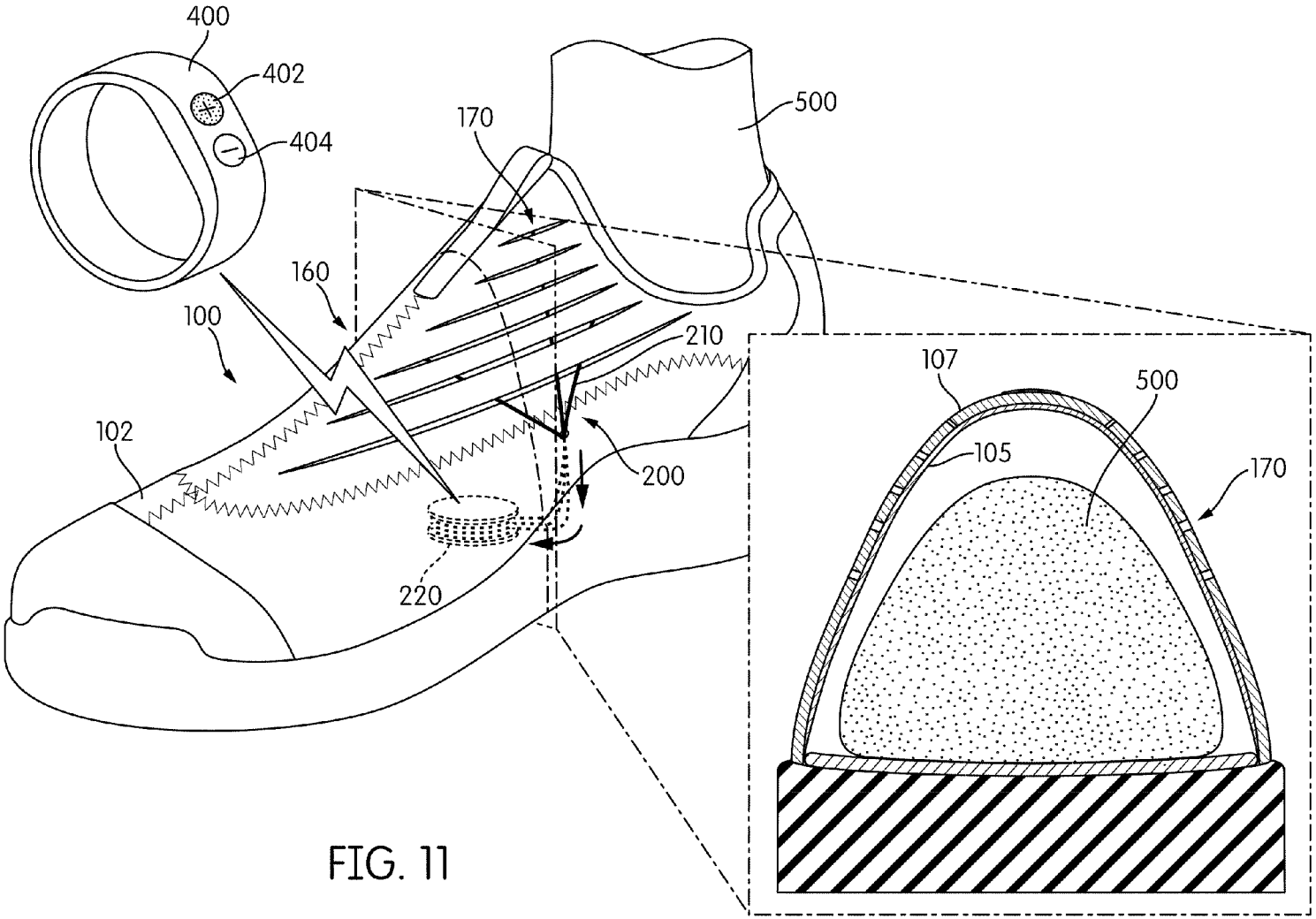
FIG. 11 is a schematic view of an embodiment of an article of footwear with an instep portion starting to contract in volume.
Figure 12:
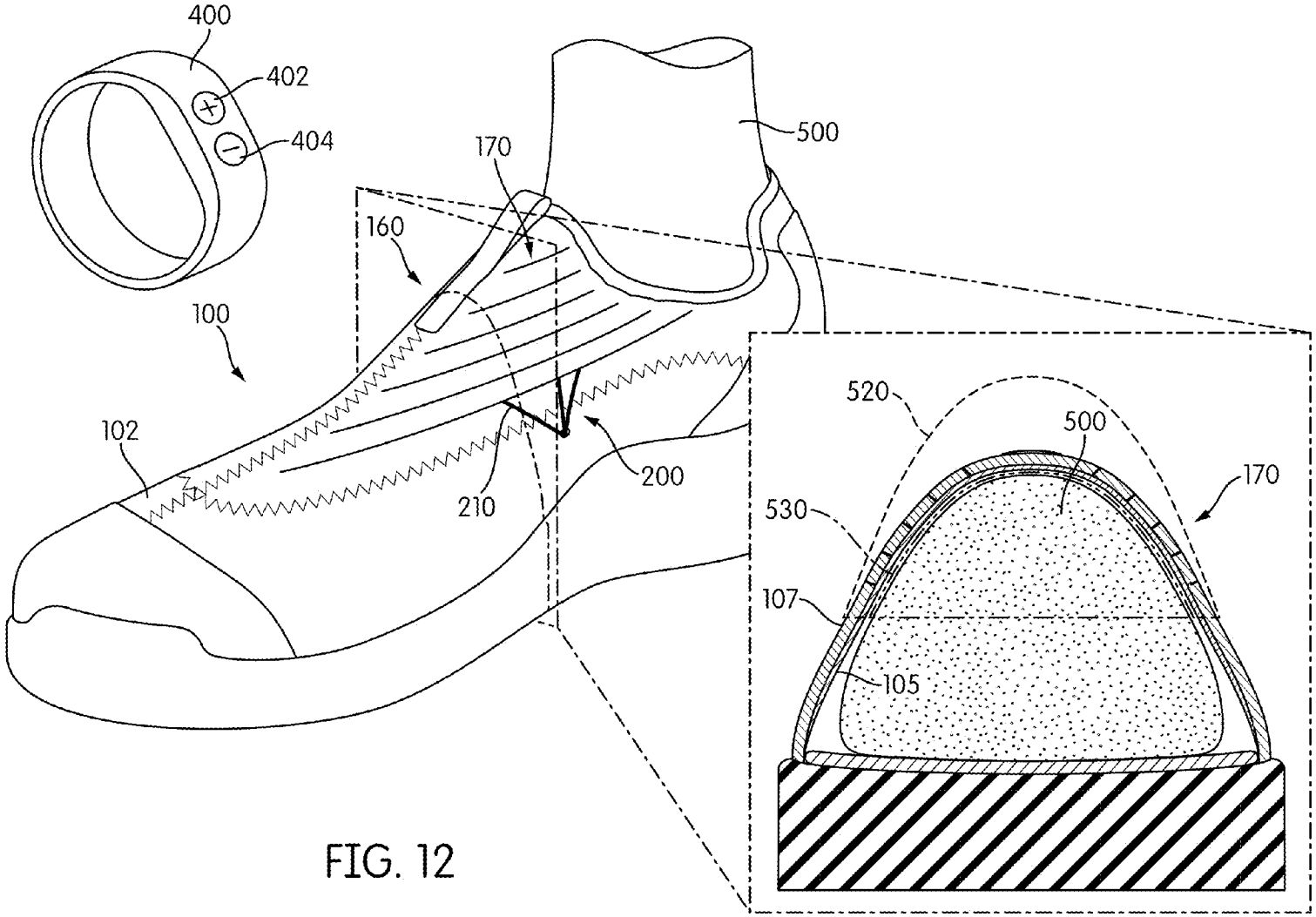
FIG. 12 is a schematic view of an embodiment of an article of footwear with an instep portion in a fully contracted state.

FIGS. 10 through 12 illustrate a sequence of states of article 100 in which tensioning system 200 is used to tighten upper 102. Referring first to FIG. 10, tensioning system 200 is in a fully loosened or minimally tensioned state. In this state, plurality of tensioning members 210 may not substantially restrict the expansion of instep portion 160. Therefore, instep portion 160 is capable of stretching to accommodate foot 500, which has been inserted into upper 102. Specifically, plurality of channels 170 can expand to accommodate an increased volume for instep portion 160. In some cases, this configuration may provide spacing between instep portion 160 and instep 505 of foot 500, as seen in the enlarged cross-section of FIG. 10.

Referring next to FIG. 11, a user may begin to tighten instep portion 160 by pressing tightening button 402. This causes tensioning device 220 to wind plurality of tensioning members 210, thereby applying a generally downward tension to instep portion 160. As plurality of tensioning members 210 pull down in instep portion 160, plurality of channels 170 may decrease in width. This results in a decreased volume for instep portion 160 (and upper 102), as shown in the enlarged cross-section of FIG. 11. In other words, increasing the tension of plurality of tensioning members 170 may act to decrease the volume of instep portion 160.

Generally, tensioning device 220 may continue wind plurality of tensioning members 210 as long as tightening button 402 is pressed (or until a signal that a desired tension level has been achieved). This continued tensioning may act to close plurality of channels 170 until previously separated sections of outer layer 107 come into contact.

A fully tightened state for instep portion 160 (and upper 102 more generally) is shown in FIG. 12. As seen in FIG. 12, the volume of instep portion 160 has been substantially decreased from a first volume 520 (indicated schematically in the cross-section of FIG. 12) to a second volume 530 (indicated schematically in the cross-section of FIG. 12). In particular, first volume 520 represents the approximate volume of instep portion 160 in the fully un-tensioned state seen in FIG. 10, while second volume 530 represents the volume of instep portion 160 in a fully tightened state. It should be clear that while the sections indicated schematically as first volume 520 and second volume 530 are shown as two dimensional sections, these are intended to be indicative of three dimensional volumes bounded from above by instep portion 160.

Although not shown in the figures, a similar process for releasing tension in plurality of tensioning members 170 may occur when a user depresses loosening button 404. This acts to unwind plurality of tensioning members 170 from tensioning device 220, which allows instep portion 160 to increase in volume when forces are applied by the foot to instep portion 160 (or directly by a user grabbing tab portion 175). The degree to which tensioning device 220 is loosened will affect the degree to which instep portion 160 can expand (and therefore the degree to which opening 140 may likewise expand).

In different embodiments, the mechanism that allows the volume of an instep portion to be changed may vary. The embodiments shown in FIGS. 1-12 utilize an instep portion with channels that can increase and decrease in size. However, other embodiments could make use of other provisions that facilitate expansion or contraction of the volume of an instep portion.

Figure 13:
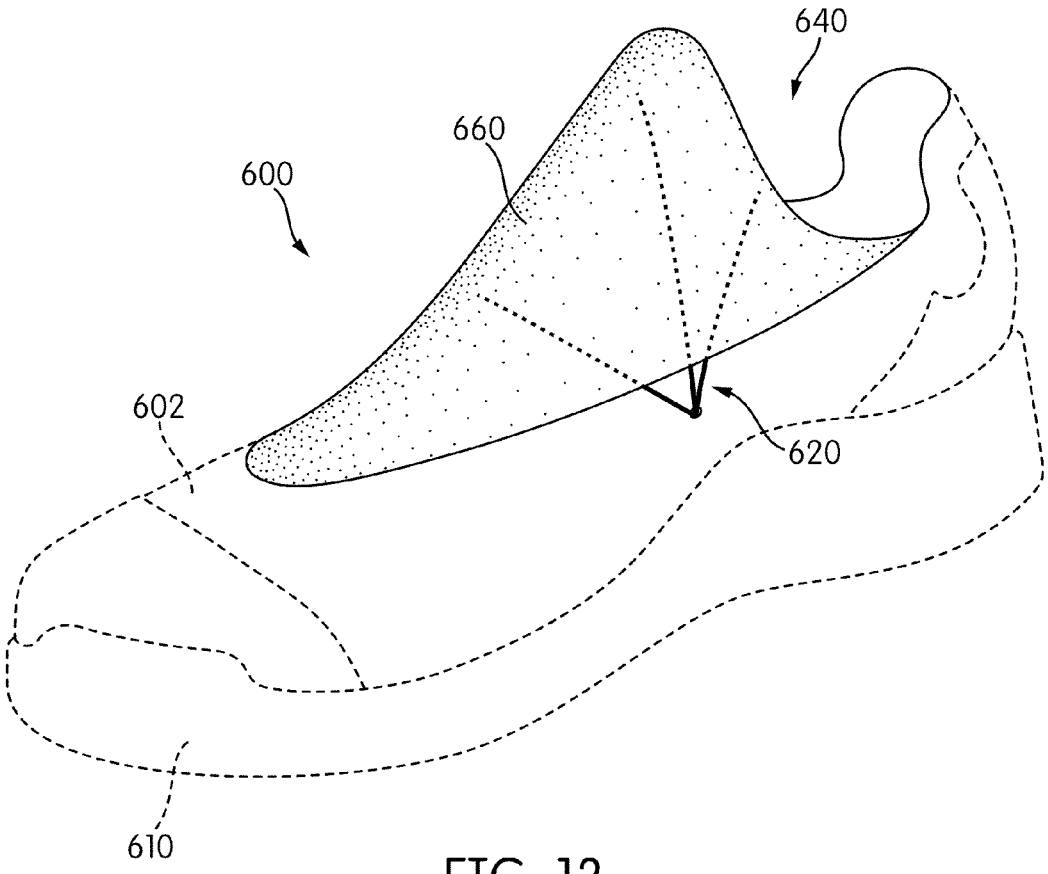
FIG. 13 is a schematic isometric view of an embodiment of an article of footwear with an instep portion in an expanded state.
Figure 14:
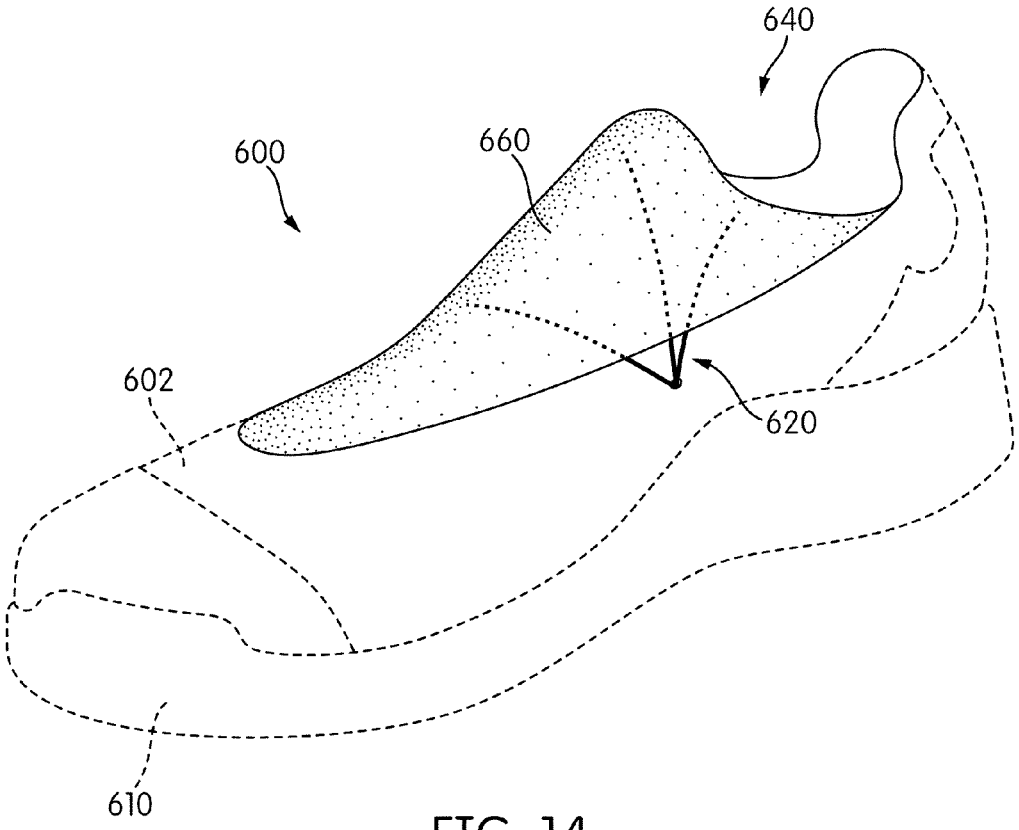
FIG. 14 is a schematic isometric view of an embodiment of an article of footwear with an instep portion in a contracted state.

FIGS. 13 and 14 illustrate a schematic embodiment of an article 600, which includes an upper 602 and a sole structure 610. Article 600 may further include an instep portion 660 having an adjustable volume and an opening 640 that varies in size with instep portion 660. In this embodiment, the structure of instep portion 660 is shown schematically, without depicting a particular mechanism by which instep portion 660 can expand or contract. Generally, such provisions could include channels, slots, pleats, elastic materials, as well as any other mechanical and/or material provisions that would facilitate substantial changes in volume of instep portion 660.

Additionally, in this embodiment, a tensioning system 620 may be used to apply tension to instep portion 660. By increasing the tension applied to instep portion 660, the volume of instep portion 660 can be contracted, as seen when comparing the shape of instep portion 660 in FIG. 13 with the shape of instep portion 660 in FIG. 14.

Figure 15:
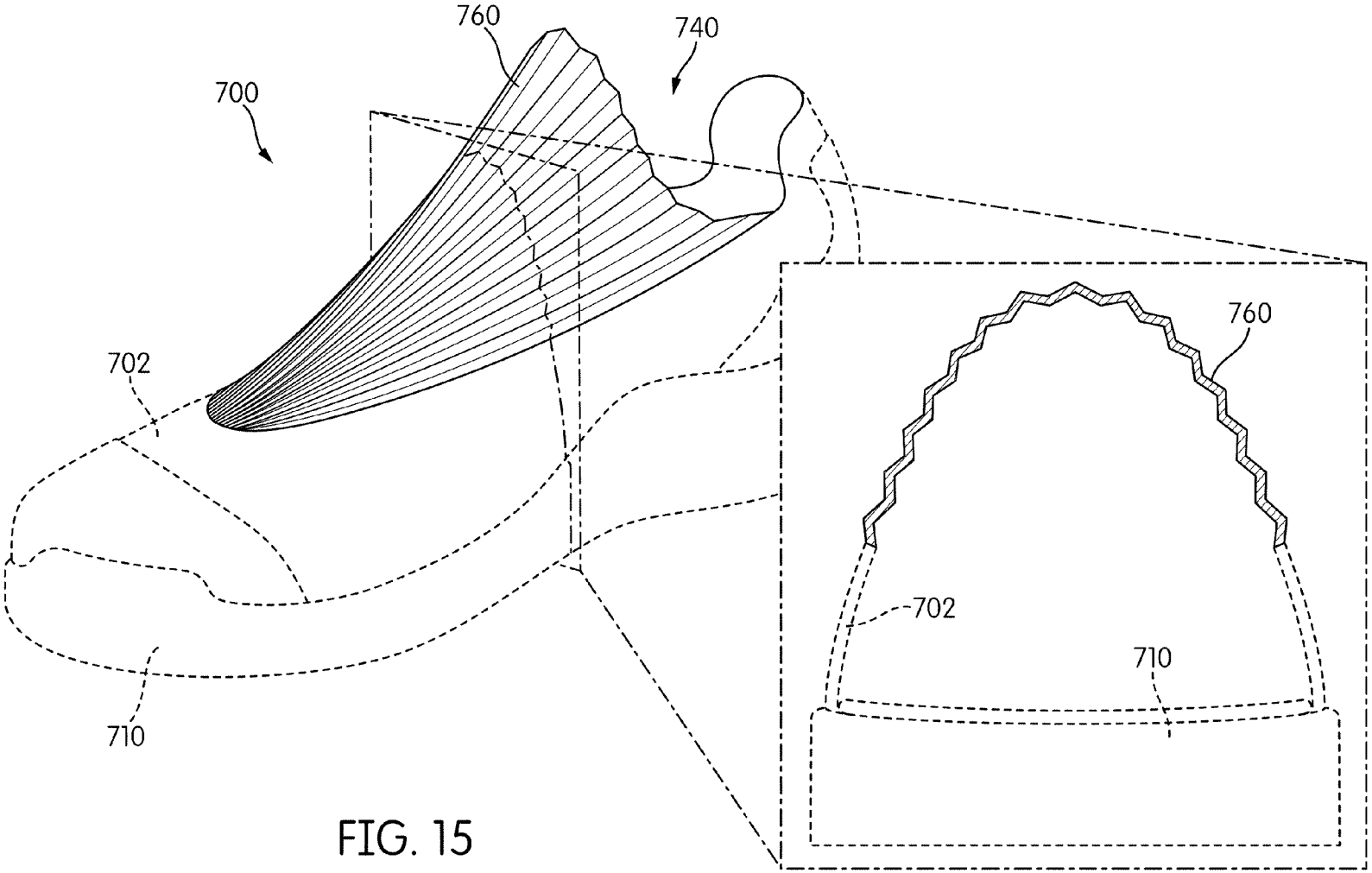
FIG. 15 is a schematic isometric view of another embodiment of an article of footwear with an instep portion in an expanded state.
Figure 16:
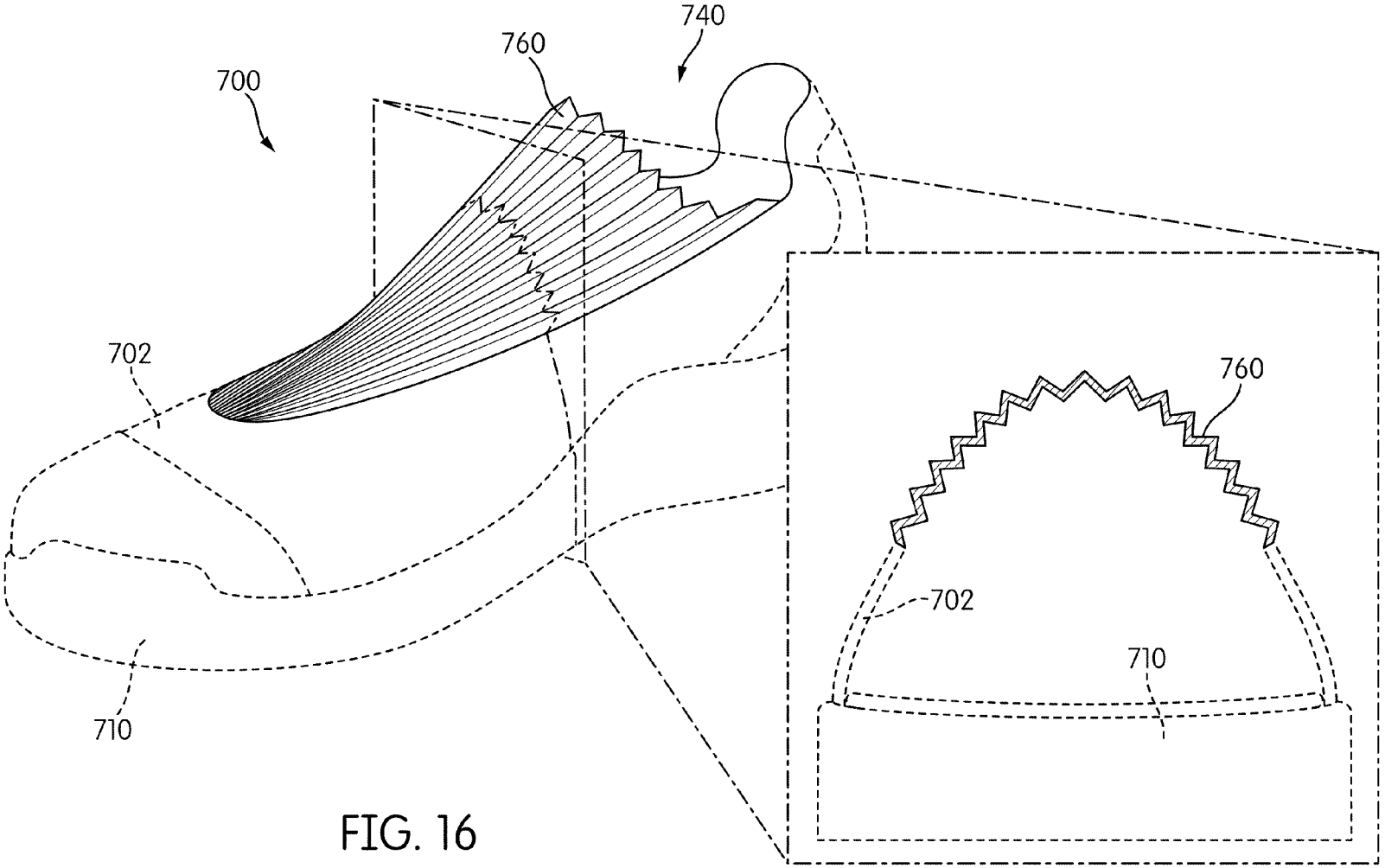
FIG. 16 is a schematic isometric view of another embodiment of an article of footwear with an instep portion in a contracted state.

FIGS. 15 and 16 illustrate still another embodiment of an instep portion with a variable volume. Referring to FIGS. 15 and 16, an article 700 may include an upper 702 and sole structure 710. Upper 702 can include an opening 740 as well as an instep portion 760. In this embodiment, instep portion 760 has a fan-fold geometry. Thus, applying tension across instep portion 760 using a tensioning system (not shown) allows the volume of instep portion 760 to be decreased. Other embodiments could incorporate a section of material having pleats to facilitate expansion and contraction in a similar manner.

Figure 17:
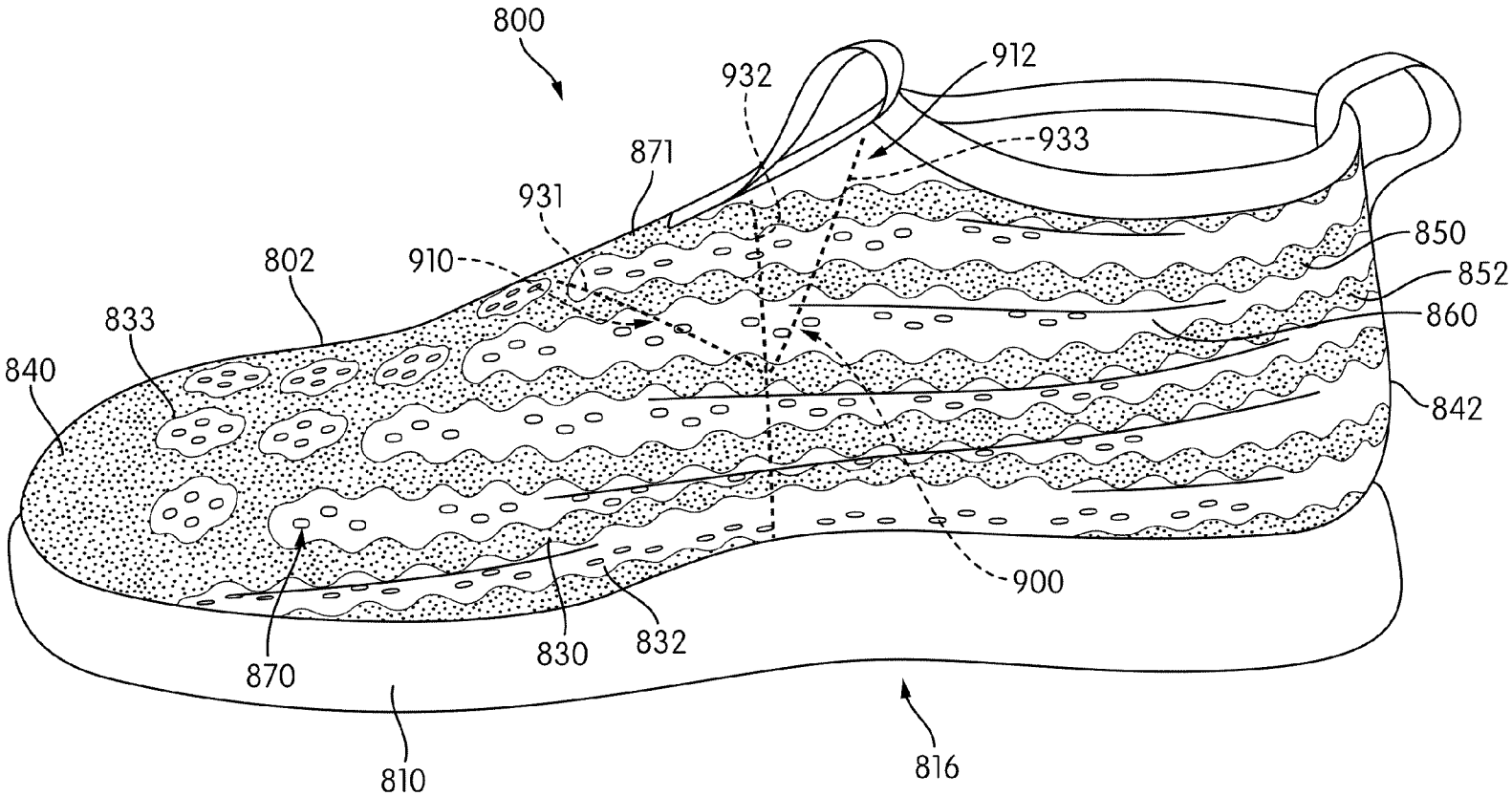
FIG. 17 is a schematic lateral isometric view of another embodiment of an article of footwear.
Figure 18:
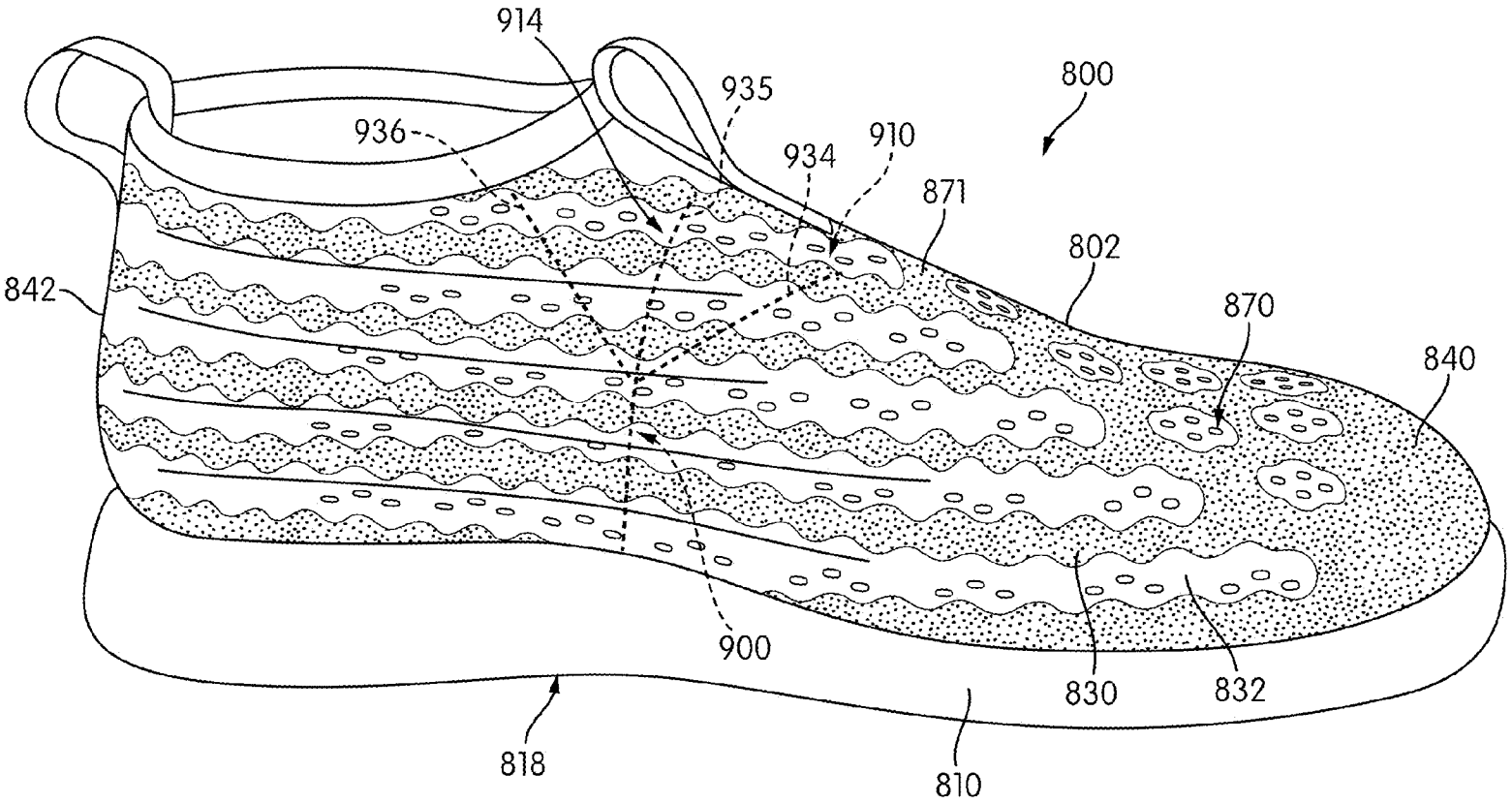
FIG. 18 is a schematic medial isometric view of another embodiment of an article of footwear.

FIGS. 17 and 18 illustrate schematic isometric views of an embodiment of an article of footwear 800 that includes a tensioning system. Article of footwear 800 may include sole structure 810 and upper 802. As with a previous embodiment, article 800 may generally be closed along the top of upper 802, including along instep portion 871. In other words, instep portion 871 may be configured as a closed portion. In particular, instep portion 871 may be closed around the instep of a foot, when a foot has been inserted into article 800.

In some embodiments, a tensioning system 900 may be provided. For purposes of illustration, only some components of tensioning system 900 are shown in the current embodiment. Moreover, in contrast to some previous embodiments, in the embodiment of FIGS. 17-18, the components of tensioning system 900 are not visible on an outer surface of upper 802. In some cases, tensioning system 900 may be similar to the tensioning systems of the earlier embodiments. In particular, tensioning system 900 may include plurality of tensioning members 910.

Plurality of tensioning members 910 may be further grouped into a first group of tensioning members 912 and a second group of tensioning members 914, which are associated with lateral side 816 and medial side 818, respectively, of upper 802. Generally, each group could have any number of tensioning members. In some embodiments, first group of tensioning members 912 and second group of tensioning members 914 may each comprise three distinct tensioning members. However, other embodiments could include any other number of tensioning members in each group of tensioning members, including one, two, three, four or more than four tensioning members. In particular, as seen in FIG. 17, first group of tensioning members 912 may include first tensioning member 931, second tensioning member 932 and third tensioning member 933. Likewise, as seen in FIG. 18, second group of tensioning members 914 may include fourth tensioning member 934, fifth tensioning member 935 and sixth tensioning member 936.

As in the earlier embodiments, the tensioning members in each group may be spread apart over instep portion 871, and may be adjacent one another along the sides of upper 802. Additionally, each tensioning member extends down to a tensioning device (not shown), which applies tension to each tensioning member.

In some embodiments, upper 802 may be configured with provisions to contract in volume under tension, especially in instep portion 871 and adjacent portions. In some embodiments, upper 802 is configured with first set of portions 830 having a first material construction and a second set of portions 832 having a second material construction that is different from the first material construction. For purposes of illustration, an exemplary configuration of first set of portions 830 is shown in FIGS. 17-20 with shading, while an exemplary configuration of second set of portions 832 is shown in FIGS. 17-20 without shading.

In some embodiments, the first set of portions 830 extends through much of toe portion 840. Additionally, first set of portions 830 extend in lengthwise segments from toe portion 840 to heel portion 842. Second set of portions 832 may comprise small disjoint segments 833 within toe portion 840. Additionally, second set of portions 832 includes lengthwise segments that separate adjacent lengthwise portions from first set of portions 830. As an example, as seen in FIG. 17, a first segment 850 and a second segment 852 of first set of portions 830 are separated by a segment 860 of second set of portions 832.

In some embodiments, the first material construction (associated with first set of portions 830) and the second material construction (associated with second set of portions 832) may be substantially different. For example, in some embodiments, the second material construction may be substantially more elastic than the first material construction. In addition, in some embodiments, second set of portions 832 may be associated with plurality of holes 870, which can facilitate breathability for upper 802 and also increase flexibility for second set of portions 832. This configuration for the first material construction and the second material construction may facilitate the contraction of second set of portions 832 as upper 802 is tensioned.

Figure 19:
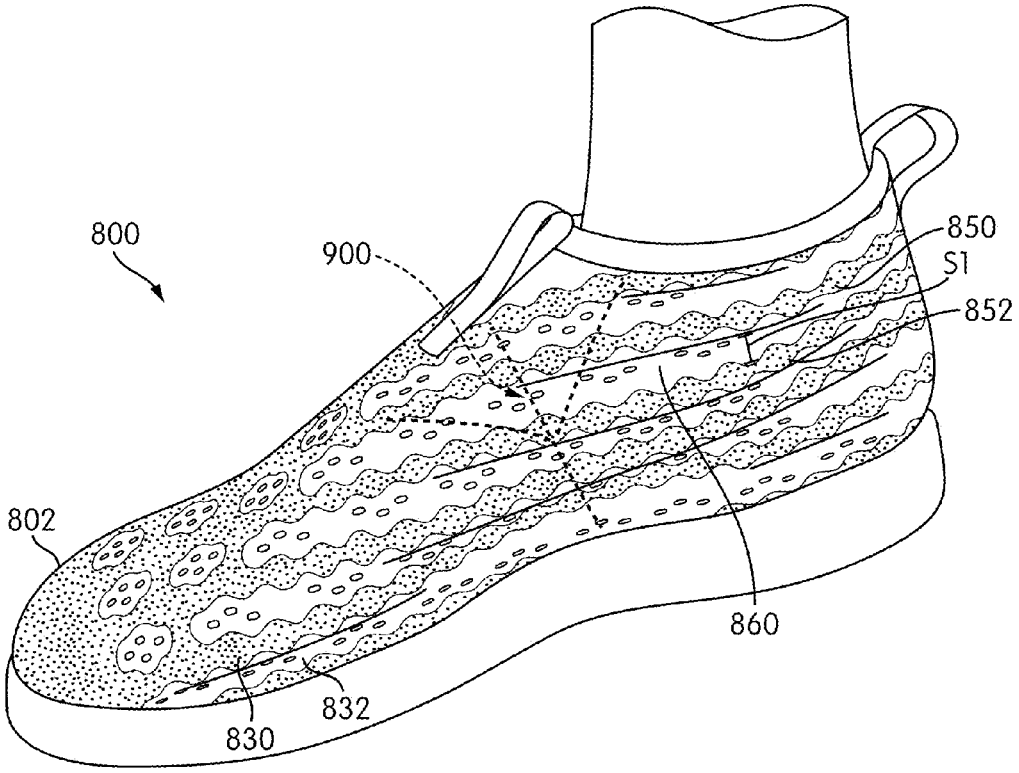
FIG. 19 is a schematic isometric view of the article of footwear of FIG. 17 in an un-tensioned state.
Figure 20:
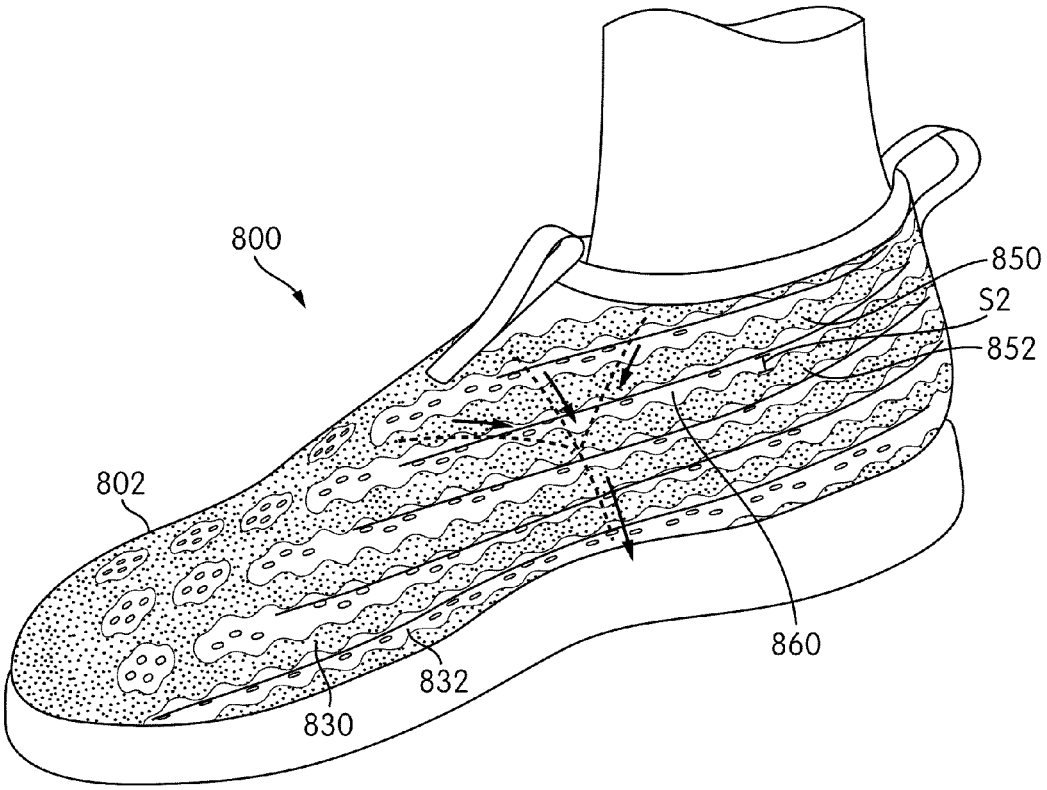
FIG. 20 is a schematic isometric view of the article of footwear of FIG. 17 in a tensioned state.

FIGS. 19 and 20 illustrate schematic isometric views of article 800 in an un-tensioned state and a tensioned state, respectively. As seen in FIG. 19, prior to tensioning upper 802 using tensioning system 900, the alternating lengthwise segments of second set of portions 832 are expanded in the widthwise direction of each segment. However, as tension is applied via tensioning system 900, the lengthwise segments of second set of portions 832 begin to contract in the widthwise direction. Thus, as seen in comparing FIGS. 19 and 20, the relative spacing between adjacent lengthwise segments of first set of portions 830 decreases. For example, segment 850 and segment 852, may be initially separated by an average spacing S1 as shown in FIG. 19. However, as segment 860 contracts, segment 850 and segment 852 are separated by an average spacing S2 that is substantially less than average spacing S1. As the spacing between adjacent segments of first set of portions 830 is decreased, the overall volume enclosed within upper 802 is decreased. This results in a tightened fit for upper 802 around a wearer's foot.

In different embodiments, the geometry of different portions of article 800 could vary. In an exemplary embodiment, lengthwise segments of first set of portions 830 and second set of portions 832 may generally have curved or non-linear edges. In some cases, the lengthwise segments of first set of portions 830 and second set of portions 832 have corresponding wavy edges, including alternating crests and troughs. In some embodiments, segments of first set of portions 830 that are separated by a corresponding segment from second set of portions 832 could be configured so that the crests of each segment are approximately aligned in a longitudinal direction. In such an embodiment, the crests of the segments of first set of portions 830 could come into contact with one another as second set of portions 832 contract under tension. In other embodiments, segments of first set of portions 830 that are separated by a corresponding segment from second set of portions 832 could be configured so that a crest of one segment is aligned with a trough of another segment in the longitudinal direction. In such an embodiment, the crests of one segment may fit into the troughs of another segment as second set of portions 832 contract under tension. By varying the alignment of adjacent segments from first set of portions 830, the overall fit of article 800 during a contracted or tensioned state can be tuned.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper having a toe covering portion and an entry hole for receiving a foot;

an intermediate covering portion disposed between the toe covering portion and the entry hole, wherein the intermediate covering portion is adapted to close around the instep of the foot and wherein a volume of the intermediate covering portion is variable;

wherein the intermediate covering portion includes a plurality of channels disposed along a longitudinal direction, wherein the longitudinal direction is a direction extending from a forefoot portion of the article of footwear to a heel portion of the article of footwear;

wherein each of the plurality of channels is adapted to expand in a widthwise direction, the widthwise direction is perpendicular to the longitudinal direction;

at least one tensioning member extending across the plurality of channels in the widthwise direction, wherein the at least one tensioning member extends from a sole structure of the article of footwear to the upper; and wherein increasing the tension of the at least one tensioning member substantially decreases the volume of the intermediate covering portion.

2. The article of footwear according to claim 1, wherein each of the plurality of channels is adapted to expand and contract in size.

3. The article of footwear according to claim 2, wherein the plurality of channels are approximately oriented parallel to one another.

4. The article of footwear according to claim 3, wherein the plurality of channels are configured to expand and contract in a direction approximately perpendicular to the longitudinal direction.

5. The article of footwear according to claim 1, wherein the article of footwear includes three tensioning members that extend through the intermediate covering portion, wherein the three tensioning members extend from the sole structure of the article of footwear to the upper.

6. The article of footwear according to claim 5, wherein the three tensioning members extend radially outwardly from an aperture of the article of footwear.

7. An article of footwear, comprising:

an upper having a toe covering portion and an entry hole for receiving a foot, wherein the upper includes an inner layer and an outer layer;

an intermediate covering portion disposed between the toe covering portion and the entry hole, wherein the intermediate covering portion is adapted to close around the instep of the foot and wherein a volume of the intermediate covering portion is variable;

wherein the intermediate covering portion includes a plurality of channels that extend through an entire thickness of the outer layer;

wherein each of the plurality of channels forms a gap in the outer layer to separate adjacent segments of material in the outer layer;

wherein each of the plurality of channels is adapted to expand and contract in size;

wherein each of the segments of material in the outer layer is stretched as the plurality of channels expand;

at least one tensioning member extending across each of the plurality of channels through the gap;

wherein the volume of the intermediate covering portion can be changed by adjusting the tension of the at least one tensioning member; and wherein the tension of the at least one tensioning member is controlled using a reel-based tensioning device.

8. The article of footwear according to claim 7, wherein the reel-based tensioning device includes a reel for winding the at least one tensioning member.

9. The article of footwear according to claim 8, wherein the reel-based tensioning device is a motorized device.

10. The article of footwear according to claim 9, wherein the reel-based tensioning device is controlled remotely.

11. The article of footwear according to claim 9, wherein the reel-based tensioning device is disposed in a sole structure of the article of footwear.

12. The article of footwear according to claim 7, wherein the at least one tensioning member extends from the reel-based tensioning device to a top portion of the intermediate covering portion.

13. The article of footwear according to claim 7, wherein three tensioning members extend from the reel-based tensioning device to a side of the intermediate covering portion.

14. An article of footwear, comprising:

an upper having a toe covering portion and an entry hole for receiving a foot;

an intermediate covering portion disposed between the toe covering portion and the entry hole, wherein the intermediate covering portion is closed around the instep of the foot and wherein a volume of the intermediate covering portion is variable;

wherein the intermediate covering portion includes a plurality of channels disposed along a longitudinal direction, wherein the longitudinal direction is a direction extending from a forefoot portion of the article of footwear to a heel portion of the article of footwear;

wherein each of the plurality of channels is adapted to expand and contract in size in a widthwise direction, the widthwise direction is perpendicular to the longitudinal direction;

a tensioning device;

a first tensioning member, a second tensioning member and a third tensioning member all extending between the tensioning device and the intermediate covering portion; and wherein the first tensioning member, the second tensioning member and the third tensioning member extend radially outward from an aperture on the article of footwear.

15. The article of footwear according to claim 14, wherein the first tensioning member extending to a periphery of the entry hole, the periphery forming a rearward boundary for the intermediate covering portion.

16. The article of footwear according to claim 15, wherein the intermediate covering portion includes a top portion that is disposed furthest from a lower surface of the article of footwear, and wherein the second tensioning member extends to the top portion.

17. The article of footwear according to claim 16, wherein the intermediate portion includes an upper forward portion that is disposed forwards of the top portion and wherein the third tensioning member extends to the upper forward portion.

18. The article of footwear according to claim 14, wherein the first tensioning member, the second tensioning member and the third tensioning member are used to adjust the volume of the intermediate covering portion.

19. The article of footwear according to claim 18, wherein the first tensioning member, the second tensioning member and the third tensioning member are associated with a lateral side of the intermediate covering portion and wherein the article of footwear further includes a fourth tensioning member, a fifth tensioning member and a sixth tensioning member that are associated with a medial side of the intermediate covering portion.

20. The article of footwear according to claim 19, wherein the first tensioning member, the second tensioning member, the third tensioning member, the fourth tensioning member, the fifth tensioning member and the sixth tensioning member are arranged approximately symmetric with respect to the lateral side and the medial side of the intermediate covering portion.

21. The article of footwear according to claim 14, wherein the upper further includes:

a first lengthwise segment made of a first material, wherein the first lengthwise segment extends in a longitudinal direction of the upper;

a second lengthwise segment made of a second material, wherein the second lengthwise segment extends in the longitudinal direction of the upper;

a third lengthwise segment made of the first material, wherein the third lengthwise segment extends in the longitudinal direction of the upper;

wherein the second lengthwise segment is disposed between the first lengthwise segment and the third lengthwise segment; and wherein the second material is more elastic than the first material.

22. The article of footwear according to claim 21, wherein the second lengthwise segment contracts more than the first lengthwise segment when tension is applied by the first tensioning member, the second tensioning member and the third tensioning member, and wherein the second lengthwise segment contracts more than the third lengthwise segment when tension is applied by the first tensioning member, the second tensioning member and the third tensioning member.

* * * * *